US006944545B2

(12) United States Patent
Close et al.

(10) Patent No.: US 6,944,545 B2
(45) Date of Patent: Sep. 13, 2005

(54) SYSTEM AND METHOD FOR DETERMINING THE INCLINATION OF A WELLBORE

(76) Inventors: David A. Close, 4004 Tejon Cir., Austin, TX (US) 78734; Steve C. Owens, 22 Pebble Hollow Ct., The Woodlands, TX (US) 77381

( * ) Notice: Subject to any disclaimer, the term of this patent is extended or adjusted under 35 U.S.C. 154(b) by 117 days.

(21) Appl. No.: 10/396,056

(22) Filed: Mar. 25, 2003

(65) Prior Publication Data

US 2005/0154532 A1 Jul. 14, 2005

(51) Int. Cl.[7] ..... G06F 13/10

(52) U.S. Cl. ..... 702/6; 702/179; 702/182; 702/188

(58) Field of Search ..... 702/6–13, 16, 702/9, 54, 94, 151, 154, 159, 179; 33/313; 166/302; 175/27; 701/50

(56) References Cited

U.S. PATENT DOCUMENTS

| | | | | |
|---|---|---|---|---|
| 2,334,950 A | | 11/1943 | Opocensky | |
| 2,624,952 A | | 1/1953 | MacLagan | |
| 2,775,043 A | | 12/1956 | Suter et al. | |
| 5,103,920 A | * | 4/1992 | Patton | 175/45 |
| 5,537,753 A | | 7/1996 | Otte et al. | 33/304 |
| 5,606,124 A | | 2/1997 | Doyle et al. | 73/152.01 |
| 5,612,678 A | | 3/1997 | Shibata | 340/628 |
| 5,630,280 A | | 5/1997 | Crossan, Jr. | 33/366 |
| 5,680,708 A | | 10/1997 | James | 33/366 |
| RE35,790 E | | 5/1998 | Pustanyk et al. | 415/40 |
| 5,852,878 A | | 12/1998 | Seipp, Jr. et al. | 33/366 |
| 5,934,373 A | * | 8/1999 | Warpinski et al. | 166/250.1 |
| 6,226,595 B1 | * | 5/2001 | Rossi et al. | 702/10 |
| 6,249,984 B1 | | 6/2001 | Barsky et al. | 33/366.15 |
| 6,272,434 B1 | | 8/2001 | Wisler et al. | 702/9 |
| 6,282,804 B1 | | 9/2001 | Jiang | 33/366.21 |
| 6,347,282 B2 | | 2/2002 | Estes et al. | 702/6 |
| 6,349,477 B1 | | 2/2002 | Hunter | 33/366.14 |
| 6,370,784 B1 | * | 4/2002 | Hunter et al. | 33/395 |
| 6,405,808 B1 | | 6/2002 | Edwards et al. | 175/45 |
| 6,453,239 B1 | | 9/2002 | Shirasaka et al. | 701/220 |
| 6,484,818 B2 | | 11/2002 | Alft et al. | 175/45 |
| 6,631,563 B2 | * | 10/2003 | Brosnahan et al. | 33/313 |

* cited by examiner

*Primary Examiner*—Marc S. Hoff
*Assistant Examiner*—Felix Suarez
(74) *Attorney, Agent, or Firm*—Kevin L. Daffer; Daffer McDaniel, LLP

(57) ABSTRACT

A well survey system comprising and electronic survey tool for determining the inclination of a wellbore is disclosed herein with methods of use. In some embodiments, the electronic survey tool includes an electrolytic tilt sensor adapted to measure a first tilt angle within a first plane and a second tilt angle within a second plane of the electrolytic tilt sensor. The electronic survey tool also includes a system processor for determining the inclination of the wellbore based on the first and second tilt angles. As such, a drop-in replacement and improvement on a mechanical critical vertical drift (CVD) tool is provided herein. The electronic survey tool of the present invention also improves upon and overcomes the disadvantages of prior art electronic survey tools. Due to the stability of the improved survey tool over time and with changes in ambient temperature, for example, the improved survey tool does not require periodic recalibration or correction of measurements for errors and biases.

43 Claims, 7 Drawing Sheets

SYSTEM AND METHOD FOR DETERMINING THE INCLINATION OF A WELLBORE

BACKGROUND OF THE INVENTION

1. Field of the Invention

This invention relates to bottom hole assemblies for drilling oilfield wellbores and, more particularly, to the use of electrolytic tilt sensors for determining the inclination of a wellbore.

2. Description of the Related Art

The following descriptions and examples are not admitted to be prior art by virtue of their inclusion within this section.

To obtain hydrocarbons such as oil and gas, wellbores (also referred to as boreholes) are drilled into the earth by rotating a drill bit attached at the end of a drilling assembling generally referred to as a "Bottom Hole Assembly" (BHA). In some cases, directional drilling activity may be utilized to produce highly deviated and/or substantially horizontal wellbores. For example, a directional well may be desirable to increase hydrocarbon production and/or to navigate drilling activity towards a remote location. Due to the high cost of directional drilling activity, however, the majority of current drilling activity is focused on producing substantially vertical wellbores. As such, wellbores may be drilled in substantially any direction or directions from the Earth's surface to a "target zone", the path between which is carefully planned prior to drilling. Due to the cost of drilling and the need for restricting drilling activity to the planned wellbore path, however, it is essential to periodically monitor the position and direction of the BHA during drilling operations.

Due to the high cost of directional drilling, about 70% of wellbores are planned and drilled vertically. These vertical wellbores require a means for demonstrating "verticality" (i.e., demonstrating that the well is being drilled in a substantially vertical plane) through the drilling process. To determine the wellbore verticality or inclination, a well survey may be conducted by periodically lowering or dropping a survey tool, or "well logging instrument", into the wellbore. For example, a critical vertical drift (CVD) tool is a survey tool commonly used to measure the inclination of vertical wellbores. In general, the CVD tool includes an elongated tubular housing, which is centered within a survey barrel and contains the operating elements of the tool. To conduct a well survey, the survey barrel (otherwise referred to as "running gear") is dropped or lowered into the wellbore to position the survey barrel in alignment with a longitudinal axis of the wellbore.

More specifically, the survey barrel may be run into the wellbore by a wire line cable, which is spooled from a cable drum mounted on the drill floor of a drilling rig. In this manner, the cable drum functions to raise and lower the survey barrel within a drill string, which is connected at one end to the bottom hole assembly at the drill bit. When drilling is temporarily stopped at a particular wellbore depth, the survey barrel is dropped or lowered into the drill string to land on a centralizing ring arranged above the drill bit. Such a ring is generally referred to as a "landing ring" or "Totco ring." Consequently, CVD tools are also known as "drift tools" or a "Totco." The landing ring functions to position the survey barrel in the direction of the BHA, and thus, in rough alignment with the axis of the wellbore. To eliminate some of the shock associated with landing on the ring, a shock absorber or "shock subassembly" may be incorporated at the bottom of the running gear.

The housing portion of the CVD tool generally includes a pendulum having a sharply pointed projection at its lower end. The pendulum is free to pivot in any direction, and thus, is able to maintain a vertical position regardless of the inclination of the housing. As the housing is inclined in accordance with the direction of the wellbore, the axis of the pendulum becomes offset from the axis of the housing by an amount proportional to the angular inclination of the wellbore. Such an "inclination angle" is described herein as the angular deviation between a longitudinal axis of the wellbore and the gravitational vector.

In addition to the pendulum, the housing includes timing and recording elements, which control the sliding movement of a chart holder coupled to one end of the recording element. The chart holder carries a disk-like chart typically constructed of thin metal or paper and includes a plurality of equally spaced concentric circles printed thereon. In most cases, the space between each of the concentric circles indicates one or more degrees of inclination. After a predetermined time, in which the pendulum is allowed to come to rest after landing, the recording elements causes the chart holder to move upwardly, thereby engaging the disk-like chart with the pointed projection of the pendulum and producing a perforation in the disk. Subsequently, the disk may (or may not) be rotated to another angular position before a second engagement between the disk and pendulum produces a second perforation.

After completion of the second engagement, the CVD tool is withdrawn from the wellbore and retrieved at the surface for examination by an operator. The position of the perforations on the disk relative to the concentric circles provide the measured wellbore inclination at the time and wellbore depth the survey was taken. A reading in the center of the disk indicates a substantially vertical inclination measurement, whereas an "off center" reading indicates the amount of wellbore inclination. The first and second perforations may also be compared against one another for determining a general accuracy of the overall inclination measurement.

Conventional CVD tools, however, present several disadvantages when used in current drilling operations. For example, reading of the disk in not only subjective, but also difficult due to the small size of the disk. In most cases, the disk must be read under a magnifying element to obtain a reading. As such, the accuracy of the reading may be compromised due to operator subjectivity. Another disadvantage of conventional CVD tools is the constraint on operation within specific ranges of inclination angles. As such, an approximate wellbore inclination angle must be known prior to conducting a well survey. Otherwise, an inaccurate reading may result when the wellbore inclination angle is outside an operational range of the particular CVD tool used to conduct the well survey.

Furthermore, conventional CVD tools use a mechanical timing element, which is set at the surface for delaying the recordings (i.e., the first and second engagements) by predetermined and estimated amounts of time. As such, conventional CVD tools lack a means for automatically detecting the occurrence of a "landing event" (i.e., the shock detected when a tool lands at the bottom of the wellbore). In addition, conventional CVD tools cannot distinguish between a landing event and other "shock events" (i.e., vibration due to motion of the tool through a wellbore and/or due to wire line cable problems). Therefore, an inaccurate reading may result when the wellbore inclination angle is recorded at the wrong time and/or place within the wellbore.

Yet another disadvantage of conventional CVD tools is the limited number of measurements allowed during a single survey. As noted above, conventional CVD tools obtain a maximum of two readings (i.e., first and second perforations) before the device must be retrieved and the disk replaced. In this manner, conventional CVD tools do not allow a plurality of inclination measurements to be recorded during a single well survey. Since conventional CVD tools record data mechanically, they are not conducive to electronic storage and processing of the measurement data. Finally, the cost of using and servicing conventional CVD tools continues to increase as the technology associated with such tools becomes increasingly outdated.

While many electronic tools have been developed to address the problems outlined above, the basic mechanical CVD tool is still used in most drilling operations today. Reasons for failure of the industry to accept such electronic tools may include, but are not limited to, undesirable in size, cost and ease of use, as compared to the conventional device. Therefore a need exists for a drop-in replacement of the conventional CVD tool. Preferably, such a drop-in replacement would be of substantially equivalent size, cost, and ease of use as compared to conventional CVD tools without suffering from the disadvantages described above.

SUMMARY OF THE INVENTION

The problems outlined above may be in large part addressed by an improved electronic survey tool, thereby providing a drop-in replacement for the mechanical CVD tool while overcoming the disadvantages thereof. In a preferred embodiment, the improved electronic survey tool is substantially equivalent in size to the CVD tool, and thus, may be implemented with same running gear used by the CVD tool. As such, the costs associated with implementing the improved survey tool are greatly reduced as compared to the upgrade costs associated with implementing larger, less compatible electronic survey tools, such as those described below. A conveniently sized new survey tool would also allow the old and new tools to operate concurrently, thereby providing a means for comparison between the measurements obtained with the old and new tools.

The electronic survey tool of the present invention also overcomes the disadvantages of prior art electronic survey tools. A particular advantage of the improved survey tool is its stability over time and with changes in ambient temperature. As such, the improved survey tool does not require periodic recalibration to maintain accuracy and repeatability. In addition, measurements obtained with the improved survey tool do not require constant correction for systematic errors and biases. As another advantage, a linear function may be used to determine wellbore inclination from measurements obtained with the improved electronic survey tool. Unlike the non-linear functions associated with prior art electronic survey tools, a linear function would exhibit a highly increased resolution around zero degrees. Thus, the improved electronic survey tool can be used for accurately measuring wellbore inclination in substantially vertical wellbores. Furthermore, an improved electronic survey tool would be reliable when utilized in substantially any survey system, such as a Wire Line ("WL"), a Measurement-While-Drilling ("MWD") or a Measurement-After-Drilling ("MAD") survey system.

A well survey system comprising an improved survey tool for determining the inclination of a wellbore is disclosed herein. In some embodiments, the survey tool includes an electrolytic tilt sensor adapted to measure a first tilt angle within a first plane and a second tilt angle within a second plane of the electrolytic tilt sensor, where the second plane is orthogonal to the first plane. In addition, the survey tool may include a system processor adapted to determine the inclination of the wellbore based on the first and second tilt angles.

In other embodiments, however, the electrolytic tilt sensor may be further adapted to measure a plurality of first and second tilt angles for each of a plurality of time intervals while the survey tool is moving through and while the survey tool is stationary within the wellbore. In some cases, the survey tool may also include a sensor processor adapted to calculate a set of inclination values from the plurality of first and second tilt angles measured during each of the plurality of time intervals. In this manner, the system processor (or alternatively, the sensor processor) may be adapted to determine an average inclination value and a deviation value for each set of inclination values. Subsequently, the system processor may be adapted to determine the inclination of the wellbore by selecting an appropriate one of the plurality of average inclination values as the wellbore inclination angle.

In some cases, the survey tool may also include a clocking device for tracking a survey time corresponding to each of the plurality of time intervals, and a memory device for storing the average inclination value, deviation value, and survey time corresponding to each set of inclination values. In some cases, a surface computer terminal of the well survey system may receive the data stored within the survey tool. Such a surface computer terminal may include, in some cases, a display device for displaying the received data to an operator and/or a memory device for storing the received data within a records database. In addition, the surface computer terminal may include a processor adapted to sort and remove non-associated records (i.e., records having deviation values greater than a predetermined threshold) from the records database to create an improved record database. The improved records database may then be used to select a wellbore inclination angle by disqualifying the survey measurements that may have been taken while the survey tool was moving through the wellbore.

A method for determining the inclination of a wellbore with the improved survey tool is also disclosed herein. In some embodiments, the method may include measuring a first tilt angle within a first plane and a second tilt angle within a second plane of the electrolytic tilt sensor, where the second plane is orthogonal to the first plane. In this manner, the inclination of the wellbore may be calculated from the first and second tilt angles. In a preferred embodiment, however, a plurality of first and second tilt angles may be measured for each of a plurality of time intervals while the survey tool is moving through and while the survey tool is stationary within the wellbore. In such an embodiment, the method may further include calculating a set of inclination values from the plurality of first and second tilt angles measured during each of the plurality of time intervals. Subsequently, the method may include calculating an average inclination value and a deviation value for each set of inclination values.

In this manner, the inclination of the wellbore may be determined by selecting at least one of the average inclination values. For example, an average inclination value may be selected as the inclination of the wellbore when a corresponding deviation value is less than a predetermined threshold. In another example, an average inclination value may be selected when a corresponding vibration value is less than the predetermined threshold. Such a vibration value may be detected for each set of inclination values by a separate shock sensor within the survey tool. In any case, the threshold value is preferably defined to select an average inclination value associated with survey measurements taken during times that the survey tool experiences little to no motion or vibration.

In addition, a method is disclosed herein for determining the inclination of a wellbore with an improved survey tool comprising a plurality of electrolytic tilt-sensing devices, where each of the plurality of devices is sensitive over a different operational range. In general, the method includes selecting one of the plurality of electrolytic tilt-sensing devices to measure a first tilt angle within a first plane and a second tilt angle within a second plane of the selected electrolytic tilt-sensing device. In some embodiments, an approximate inclination angle may be determined using another sensing device (e.g., an accelerometer) to thereby select the electrolytic tilt-sensing device having an appropriate operational range.

In other embodiments, however, each of the plurality of electrolytic tilt-sensing devices may be chosen in a sequential manner to measure the first and second tilt angles. In particular, a survey measurement (i.e., a pair of first and second tilt angles) may be taken with an electrolytic tilt-sensing device having a larger range of sensitivity prior to taking a survey measurement with another device having a smaller range of sensitivity. In this manner, an electrolytic tilt-sensing device having an appropriate operational range may be selected when at least one of the survey measurement values changes from a constant value to a different value. In either embodiment, the inclination of the wellbore may be determined from the survey measurements taken with the selected one of the plurality of electrolytic tilt-sensing devices.

Furthermore, a method is disclosed herein for determining when an improved survey tool has reached a target depth within a wellbore. In some embodiments, the method may include measuring a first tilt angle within a first plane and a second tilt angle within a second plane of a dual-axis tilt-sensing device. As mentioned above, however, the step of measuring preferably includes measuring a plurality of first and second tilt angles for each of a plurality of time intervals while the survey tool is moving towards the target depth. The method may also include calculating a set of inclination values from the plurality of first and second tilt angles measured during each of the plurality of time intervals. A deviation value may then be calculated for each set of inclination values. In this manner, the survey tool may be determined to have reached the target depth when a deviation value is less than a predetermined threshold. As noted above, the threshold value is preferably defined to distinguish the times during which the survey tool experiences little to no motion or vibration.

Moreover, a means is disclosed herein for an operator to specify a survey time period at a surface computer terminal while an improved survey tool is disposed within a wellbore. In some embodiments, the survey tool includes a sensor means for measuring a plurality of first and second tilt angles for each of a plurality of time intervals while the survey tool is moving through and stationary within the wellbore. The survey tool may also include a processing means for calculating a set of inclination values from the plurality of first and second tilt angles measured during each of the plurality of time intervals. A clocking means may further be included within the survey tool for correlating each of the plurality of time intervals to a corresponding set of inclination values.

In some embodiments, the surface computer terminal may include additional clocking means for flagging a survey time period within which the operator requests a survey to be taken. The surface computer terminal may also include additional processing means for comparing the survey time period with the plurality of time intervals to identify the one or more sets of inclination values, which may fall within the survey time period. Preferably, an I/O device is included for allowing an operator to request a survey time period at the surface computer terminal without communication with a downhole survey tool (i.e., while the tool is within the wellbore). In some cases, one or more survey time period may be requested by directly entering the survey time periods into the I/O device. In other cases, one or more wellbore depths may be entered in the I/O device for requesting one or more survey time periods. In yet other cases, a button or actuator upon the I/O device may be actuated to flag a current time as the requested survey time period.

Finally, a method is disclosed herein for determining if a well survey is actually conducted within a wellbore. In general, the method may include obtaining at least one value associated with the wellbore using a survey tool. In some embodiments, the at least one value may include at least one motion value obtained during each of a plurality of time intervals. For example, a motion value may include a deviation value calculated from a set of inclination values, as described above. In another example, the motion value may include a vibration value detected by a shock sensor, as described above. In other embodiments, the at least one value may include at least one temperature value obtained during each of the plurality of time intervals.

As such, the method may include detecting a characteristic pattern of the at least one value. In some embodiments, a characteristic pattern of motion values may provide indication of survey tool movement through the wellbore. For example, a pattern of motion values above a threshold followed by motion values below the threshold may provide proof that the survey tool was conveyed into the wellbore and held stationary for at least a period of time. In other embodiments, however, a characteristic pattern of temperature values may provide indication of survey tool movement through the wellbore. For example, a pattern of increasing temperature values followed by decreasing temperature values may provide proof that the survey tool was conveyed into and at least partially out of the wellbore. In any embodiment, the characteristic pattern may be compared with a pattern detected during a previous well survey to determine if the well survey is, in fact, conducted within the wellbore.

BRIEF DESCRIPTION OF THE DRAWINGS

Other objects and advantages of the invention will become apparent upon reading the following detailed description and upon reference to the accompanying drawings in which.

Figure 1:
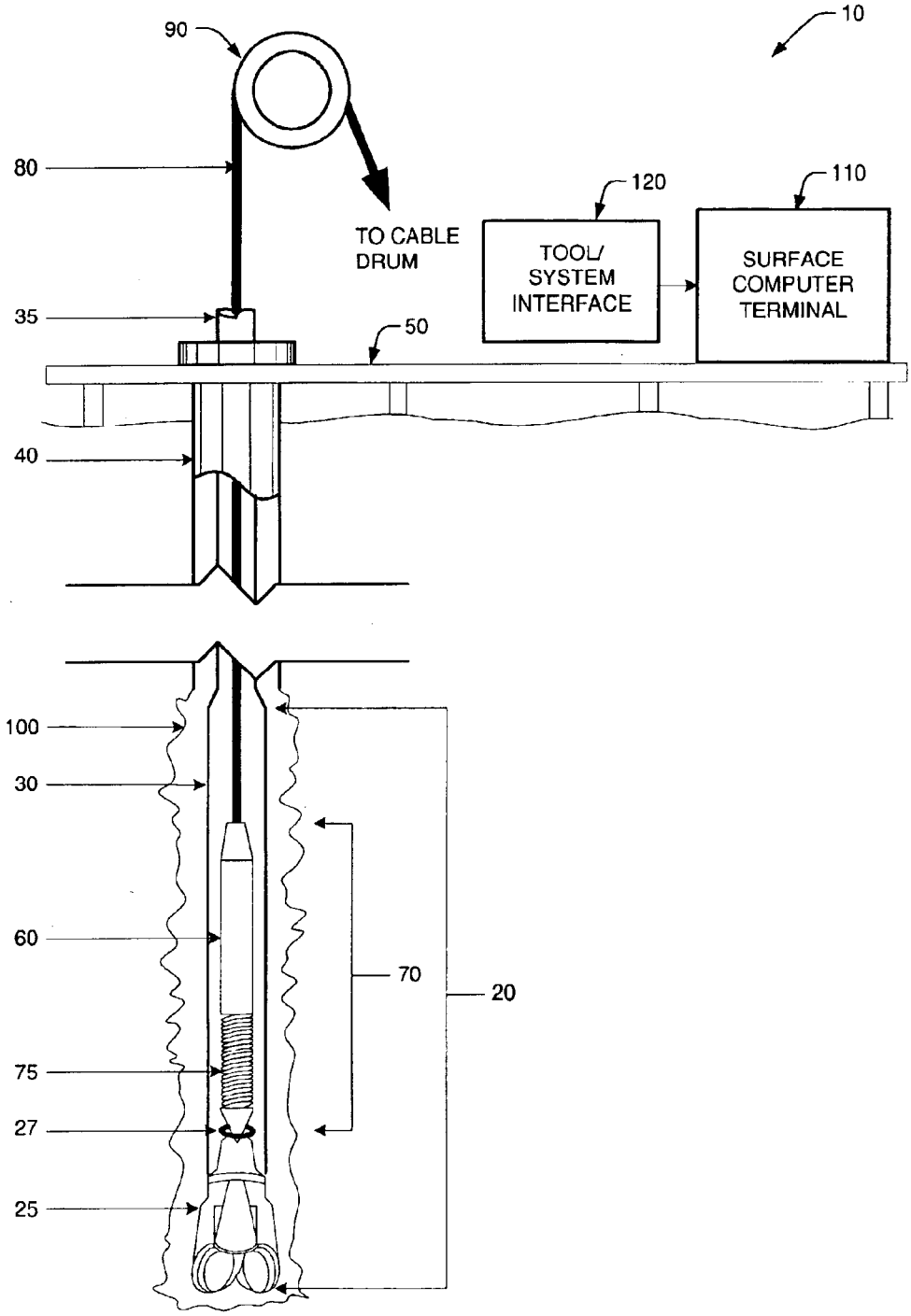
FIG.1 is a partial cross-sectional view of a Wire Line well survey system including a bottom hole assembly and survey tool disposed within a wellbore drilled into the earth.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF PREFERRED EMBODIMENTS

During drilling operations, it is often essential to monitor the position and direction of a bottom hole drilling assembly (BHA) for the purpose of restricting drilling activity to a planned wellbore path. In some cases, electronic wellbore survey systems may be used to map or plot the actual path of a wellbore by determining wellbore inclination and azimuth at various locations of depth within the wellbore. As described herein, "wellbore inclination" is the angular deviation between a longitudinal axis of the wellbore and the gravitational vector. In addition, "azimuth" may be described herein as a compass direction, or a directional heading relative to a geographic coordinate, such as north.

In some cases, a Wire Line ("WL") survey system may be utilized to determine wellbore inclination and azimuth. In general, a WL survey system includes a survey tool, which is conveyed into a wellbore after the wellbore has been drilled. In particular, the WL survey tool is suspended by a cable, and then raised and lowered through the wellbore for obtaining discrete measurements at various locations within the wellbore. Subsequently, the WL survey tool is retrieved at the surface and the discrete measurements are plotted to map the actual wellbore path.

In other cases, a Measurement-While-Drilling ("MWD") survey system may be utilized to determine wellbore inclination and azimuth. In contrast to a WL survey system, a MWD survey tool is disposed within the wellbore during the drilling process. More specifically, a MWD survey tool may be included within the bottom hole assembly and is typically coupled between the drill bit and the drill pipe. During drilling activity, rotation of a drill string (by a drilling rig located at the surface) causes the drill bit to bore into the earth. At periodic intervals, however, drill string rotation may be stopped to allow the MWD survey tool to obtain measurement data. Alternatively, or in addition to, the MWD survey tool may obtain continuous measurement data while drilling activity is maintained. In either case, the measurement data may be transmitted to the surface via "mud pulse" and/or electromagnetic ("EM") transmission. Alternatively, the measurement data may be recorded downhole and retrieved when the survey tool is pulled back to the surface. Such data retrieval is common in Measurement-After-Drilling ("MAD") survey systems.

Survey tools used in either WL, MWD and MAD survey systems commonly include accelerometers for measuring the earth's gravitational field, and more specifically, for measuring and acceleration component with respect to the gravitational vector. WL or MWD survey tools may also commonly include magnetometers for measuring the earth's magnetic field. In this manner, accelerometer and magnetometer data can be combined to determine the relative orientation of the survey tool with respect to vertical (gravity) and geographic (or magnetic) north. In most cases, the drilling assembly is held stationary while taking measurements with accelerometers and magnetometers.

In addition, accelerometer and magnetometer data may be used to calculate the position and direction of a wellbore. For instance, accelerometer data may be used to calculate a tool face and inclination angle of the wellbore. As described herein, the term "tool face" refers to the axial orientation around the longitudinal (i.e., z-axis) of the survey tool. Subsequently, the azimuth of the wellbore may be calculated from the magnetometer data in conjunction with the tool face and inclination angles.

In some cases, one or more accelerometers may be used to provide a reference with respect to gravity for determining the tool face and inclination angles. For example a single accelerometer may be positioned along one of three orthogonal axes of the survey tool. The use of such a sensor configuration, however, is uncommon in vertical well survey systems due to the undesirably small resolution (and therefore, lower accuracy) of a single accelerometer around zero degrees. As used herein, "around zero degrees" refers to an angular deviation within +/−5 degrees from the zero degree designation, or vertical. The accuracy of the sensor may be slightly improved by positioning a second accelerometer along another one of the orthogonal tool axes. However, such a sensor configuration may not provide the accuracy (e.g., ±0.1 degrees) desired in modern well survey systems.

Therefore, many survey tools commonly include a set of three mutually orthogonal accelerometers for measuring a different component of the gravitational vector with respect to the three orthogonal axes of the tool. In some cases, such a tri-axis sensor configuration may provide a better accuracy over the single-or dual-axis sensor configurations described above. A survey tool containing any number of accelerometers, however, may still present several drawbacks for use in modern well survey systems.

As noted above, the basic mechanical CVD tool is used in most drilling operations today despite the development of electronic survey tools, such as those including accelerometers and magnetometers. Reasons for failure of the industry to accept such electronic tools are noted as including differences in size, cost and ease of use as compared to the conventional device. For example, accelerometers currently used in wellbore applications are generally too expensive and too large (e.g., navigational grade accelerometers) or lack a desired accuracy (e.g., solid state micro-machined accelerometers) to qualify as a drop-in replacement for the mechanical CVD tool.

In addition, accelerometer measurements are often adversely affected by changes in the operating environment. In particular, accelerometer signal levels tend to change over time and with prolonged exposure to changes in ambient temperature. Therefore, accelerometers require periodic recalibration, which is generally very expensive, to maintain sensor accuracy and repeatability. Furthermore, accelerometer measurements must be constantly corrected for biases, such as those introduced by immediate changes in ambient temperature (e.g., due to changes in survey tool position, or depth, within the wellbore) before wellbore inclination can be determined. For at least these reasons, accelerometer survey tools are generally inadequate for determining wellbore inclination in substantially vertical wellbores.

As noted above, magnetometers are used to measure the earth's magnetic field for determining the magnetic azimuth, or the relative orientation of a survey tool with respect to magnetic north. Day to day variation in the earth's magnetic field, however, cause corresponding changes in the magnetic azimuth calculated from magnetometer measurements. In addition, magnetometer measurements are adversely affected by the presence of ferrous materials in the vicinity of the survey tool. Even the casing and/or drill pipe (which often contain ferrous materials) can significantly vary the magnetic field measured by a magnetometer. Unfortunately, variations in the measured magnetic field often lead to errors and uncertainly in the calculated azimuth or wellbore position.

As such, gyroscope measurements are sometimes used as a replacement for, or in addition to, the magnetic measurements obtained from magnetometers. Generally speaking, gyroscopes are used to measure the amount of acceleration needed to move an object from one point to another. Unlike magnetometer measurements, however, gyroscope measurements are unaffected by the presence of ferrous materials. As such, gyroscopes are sometimes used as a replacement for magnetometers, and thus, are used to provide a more accurate determination of azimuth than can be obtained from magnetometer measurements.

In other cases, however, one or more gyroscopes may be included within a survey tool in addition to a set of accelerometers and a set of magnetometers. In such a case, gyroscope measurements may be used to correct the accelerometer and/or magnetometer measurements for biases introduced by, e.g., changes in ambient temperature (for accelerometers) or the presence of ferrous materials (for magnetometers). In order to determine wellbore inclination, however, one or more gyroscopes are typically used in combination with at least one other orientation sensor, such as an accelerometer.

Unfortunately, commercially available gyroscopes are often affected by their own systematic errors and biases, which tend to deteriorate the accuracy of gyroscope measurements. In particular, gyroscope measurements tend to fluctuate over time and with changing tool face positions. As such, gyroscope survey tools may require periodic recalibration and measurement correction for errors and biases. However, the method of compensating for such errors and biases often differs depending on the particular survey system utilized.

In wire line applications, for example, reference measurements can be obtained at the surface before and after a wellbore survey is conducted. As such, gyroscope alignment biases (i.e., biases between gyroscopes positioned along the x, y and z axes of the tool) can be measured at the surface by determining the difference between reference measurements taken at the beginning and ending of the wellbore survey. In addition, the survey tool may be rotated at the surface for obtaining reference measurements at several different tool face positions. In this manner, tool face biases (i.e., biases between gyroscopes positioned along the x and y axes of the tool) can be determined from the tool face reference measurements taken at the surface. In some cases, the alignment and tool face biases may be used to correct gyroscope measurements. The unbiased gyroscope measurements may then be used, in some cases, for correcting accelerometer and/or magnetometer measurements prior to determining the wellbore inclination and azimuth values.

Unfortunately, the methods described above for determining gyroscope biases in wire line applications are generally unreliable in MWD applications. Determination of the gyroscope alignment bias (e.g., from reference measurements obtained at the surface before and after a wellbore survey) is not considered an accurate measurement due to the extensive length of time (typically between 30 and 300 hours) between drilling assembly trips in a MWD application. In addition, though several methods have been devised to determine the tool face bias of a MWD survey tool disposed within a wellbore, such methods are only capable of providing an approximation of the actual tool face bias, and thus, cannot provide a truly unbiased measurement. Furthermore, gyroscopes are also unreliable in MWD applications due to their susceptibility to shock, temperature, and other drilling conditions.

Whether used in a WL or MWD application, commercially available gyroscopes are also too expensive and/or too large to qualify as a drop-in replacement for the mechanical CVD tool. In addition, complex calculations must be used to correct for systematic errors and biases present in gyroscope measurements before wellbore azimuth can be determined. Gyroscopes also require periodic recalibration due to "gyroscope drift", or the change in gyroscope signal levels over time. Furthermore, gyroscope measurements must be combined with position information from other non-linear sensors (e.g., accelerometers) to determine wellbore inclination. As such, survey tools including gyroscopic sensors may still lack sufficient resolution around zero degrees, and thus, remain inadequate for measuring wellbore inclination in substantially vertical wellbores.

Therefore, a need exists for an improved electronic survey tool, which overcomes the disadvantages of the electronic survey tools described above. Preferably, an improved electronic survey tool would be considerably less expensive than other electronic survey tools. In addition, an improved electronic survey tool would be substantially equivalent in size to the mechanical CVD tool, and thus, could be implemented with the running gear (i.e., survey barrel) used by the mechanical CVD tool. In this manner, costs associated with implementing the new survey tool would be greatly reduced as compared to the upgrade costs associated with implementing larger, less compatible electronic survey tools, such as those described above. In addition, a new survey tool having a substantially equivalent size to the old CVD tool would advantageously allow the old and new tools to operate concurrently. Such concurrent operation advantageously enables a means for comparison between measurements obtained from the old and new tools.

In addition, an improved electronic survey tool would remain stable over time and with changes in ambient temperature, and thus, would not require periodic recalibration to maintain accuracy and repeatability. In the same manner, measurements obtained with an improved electronic survey tool would not require constant correction for systematic errors and biases. As another advantage, a linear function may be used to determine wellbore inclination from measurements obtained with the improved electronic survey tool. Such a linear function provides easier initial calibration, as compared to non-linear functions associated with other survey tools. Furthermore, an improved electronic survey tool would be reliable when utilized in substantially any survey system, such as a WL, MWD or MAD survey system.

Turning to the drawings, exemplary embodiments of a system and methods for determining wellbore inclination are shown. In FIG. 1, for example, a simplified representation of WL well survey system 10 is shown. In general, WL well survey system 10 is shown as including bottom hole assembly (BHA) 20 within wellbore 100. In particular, BHA 20 includes drill collar 30, which along with drill pipe 35 forms a drill string. BHA 20 may also include a drilling motor assembly, one or more stabilizers, a survey tool and a drill bit. For clarification purposes, however, only drill bit 25 and drill collar 30 are illustrated in FIG. 1.

To initiate drilling, BHA 20 and the attached drill string are lowered towards the surface of the earth through casing 40, as shown in FIG. 1. During drilling, drill bit 25 is rotated by rotary motion of the drill string or rotated via a drilling motor to cut through geological formations and thereby create wellbore 100. Though not illustrated in the embodiment of FIG. 1, the system used to rotate the drill string typically includes a rotary table, which is mounted upon a floor 50 and rotated by a prime mover (such as an electric motor) at a desired rotational speed. A drilling fluid from a mud pit is circulated under pressure through the drill string by a mud pump. The drilling fluid emerges through nozzles in drill bit 25 at the bottom of the wellbore and circulates uphole through a space between the drill string and the wellbore to return to the mud pit. In this manner, the drilling fluid functions to remove drill cutting from the bottom of the wellbore. As will be described in more detail below, the drilling fluid may function as a communication path between BHA 20 and surface instrumentation.

WL well survey system 10 also includes survey tool 60 for monitoring the position and direction of BHA 20 and to enable restriction of drilling activity to the planned wellbore path. In a preferred embodiment, survey tool 60 is substantially equivalent in size to the conventional CVD tool, and thus, is configured for insertion within running gear 70. In this manner, survey tool 60 may be run into wellbore 100 by survey cable 80, which is connected to running gear 70 and spooled from a cable drum (not shown) mounted on the drill floor 50. With the assistance of pulley 90, the cable drum is configured to raise and lower survey tool 60 within the drill string.

In WL survey systems, survey tool 60 may be dropped or lowered through the drill string to land on centralizing ring 27 above drill bit 25. As stated above, ring 27 may also be referred to as "landing ring" or "Totco ring." Landing ring 27 functions to position survey tool 60 in alignment with the direction of drill bit 25, and thus, in substantial alignment with a longitudinal axis of the wellbore. To eliminate some of the shock associated with landing, shock absorber 75 may be included at the bottom of running gear 70 between survey tool 60 and landing ring 27. In some cases, survey tool 60 may include a means for communicating signals to the earth's surface via one of several methods described below.

Though not illustrated in the accompanying drawings for purposes of brevity, MWD and MAD survey systems are also considered within the scope of the present invention. In MWD and MAD survey systems, for example, a survey tool may be included as a component of the BHA, and thus, fixedly attached within the drill string near the drill bit. In particular, MWD and MAD survey tools are generally built into short drill collars that are screwed into the BHA, as opposed to WL survey tools, which are included within the running gear assemblies. Since MWD and MAD survey tools are embodied within the BHA during drilling activity, they do not require the use survey cables, shock absorbers or landing rings. MWD and MAD survey systems may, however, include a communications subassembly for transmitting signals to the earth's surface via one of several methods described below.

Figure 4:
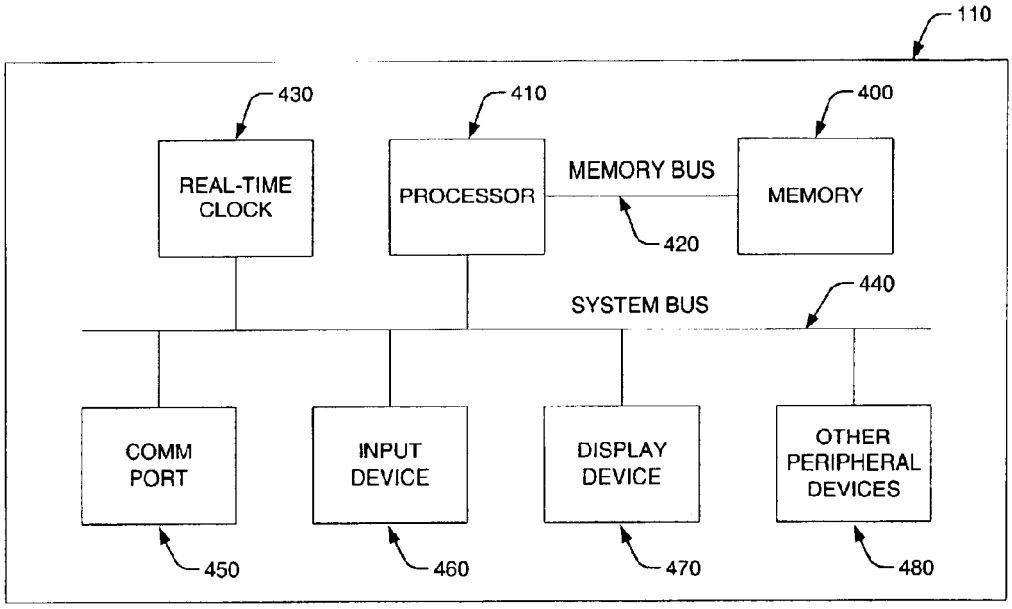
FIG. 4 is an exemplary block diagram of the surface computer terminal shown in FIG. 1.

Whether utilized in WL, MWD or MAD applications, well survey systems may include a variety of surface instrumentation including, but not limited to, surface computer terminal 110 and tool/system interface 120. In some cases, surface computer terminal 110 may comprise only a display device, such as display device 470 of FIG. 4, for displaying data received from survey tool 60 via tool/system interface 120. In other cases, surface computer terminal 110 may include a simple processor, such as processor 410 of FIG. 4, in addition to display device 470. As shown in FIG. 4, however, surface computer terminal 110 preferably includes processor 410 coupled to memory device 400 via memory bus 420. Surface computer terminal 110 may also include clock device 430, communication (COMM) port 450, input device 460 and display device 470 each coupled to processor 410 via system bus 440. In some cases, surface computer terminal 110 may be a personal computer (PC), and thus, may include additional circuitry and components appropriately found with a PC. However, surface computer terminal 110 may be any other computational device such as, e.g., a personal digital assistant ("PDA"). Surface computer terminal 110 may also include other peripheral devices 480, such as a printer, network adapter or modem.

In some cases, tool/system interface 120 is operably coupled to COMM port 450 of surface computer terminal 110 via electrical, optical, infrared or any other appropriate means of signal transmission. In other cases, however, tool/system interface 120 may be an internal component of surface computer terminal 110. In any case, tool/system interface 120 is configured to receive and transmit signals from survey tool 60 to surface computer terminal 110 for processing, storage and/or display purposes. As such, tool/system interface 120 may be configured to receive signals from survey tool 60 via electrical, "mud pulse", or electromagnetic (EM) transmission. In general, the medium chosen for transmission is dependent on the type of survey system used.

In a WL or MAD survey system, for example, tool/system interface 120 may be configured for coupling to an input/output (I/O) port of survey tool 60 after the tool is retrieved from wellbore 100. Such coupling may include direct attachment between the I/O port of survey tool 60 and tool/system interface 120, or alternatively, may include indirect attachment through a wire or cable. It may not be necessary, however, to retrieve survey tool 60 before signal transmission can occur between survey tool 60 and tool/system interface 120. For example, signals may be transmitted via an electrical wire coupled between survey tool 60 and tool/system interface 120 while survey tool 60 is downhole. It may be preferred, however, that survey tool 60 be retrieved after a WL or MAD survey and operably coupled to tool/system interface 120 for purposes of simplification and the reduced likelihood of problems associated with remote signal transmission.

In a MWD survey system, signals may be transmitted between a communication subassembly and tool/system interface 120 via "mud pulse" and/or electromagnetic ("EM") transmission. In general, "mud pulse" transmission is a known type of communication in which pressure signals are transmitted through the drilling fluid to a pressure sensor coupled at the surface to tool/system interface 120. EM transmission, on the other hand, involves transmission and detection of a low frequency electromagnetic propagation wave through the wellbore formation to an antenna coupled at the surface to tool/system interface 120.

Figure 2:
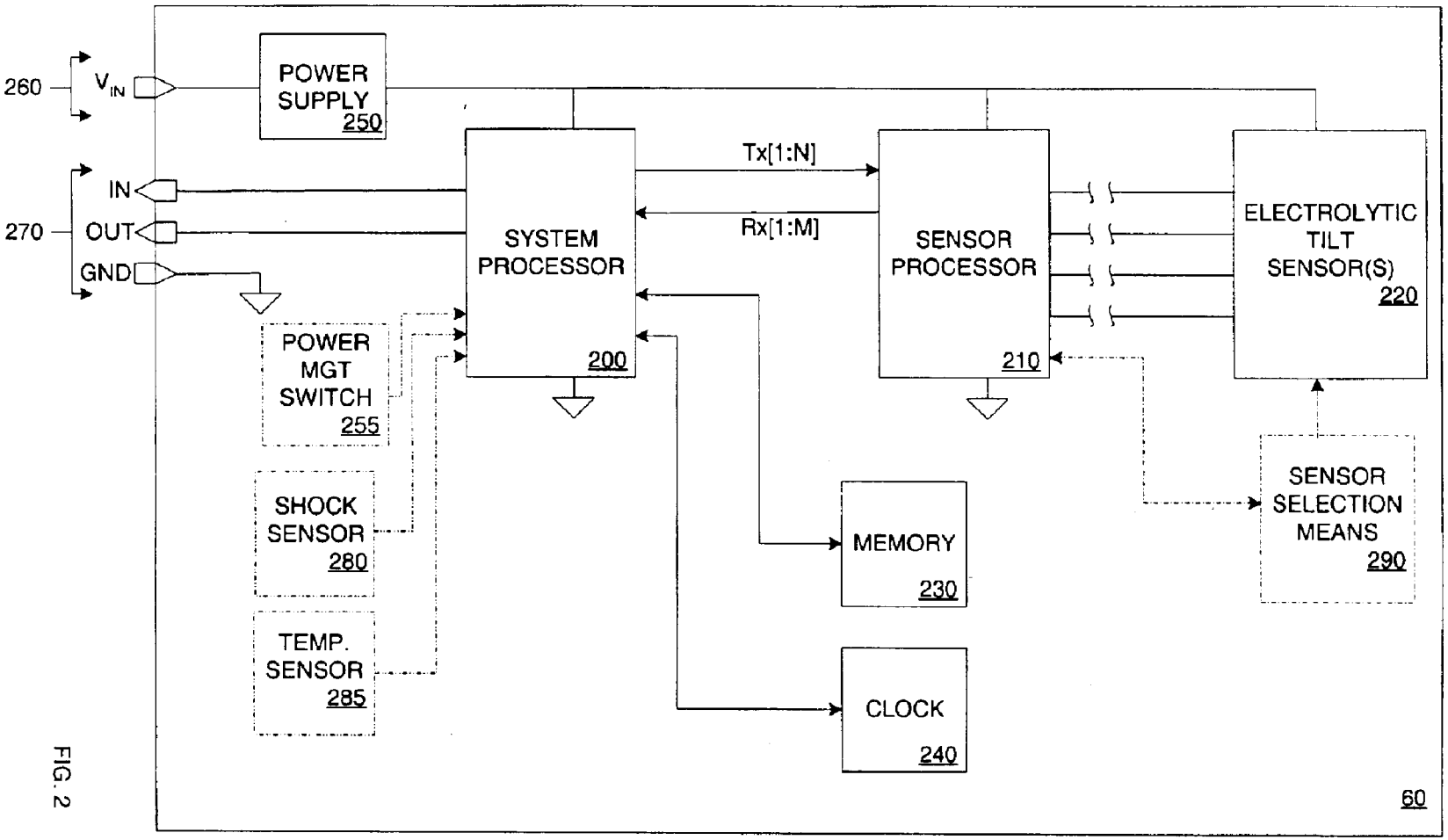
FIG. 2 is a block diagram illustrating exemplary components of the survey tool of FIG. 1.

FIG. 2 is a block diagram illustrating exemplary components within survey tool 60. Generally speaking, survey tool 60 includes at least one processing device and at least one tilt-sensing device. It may be preferred, however, that survey tool 60 also include system processor 200, sensor processor 210 and one or more tilt-sensing devices 220. As will be described in more detail below in reference to FIGS. 3A and 3B, tilt-sensing devices 220 preferably include one or more electrolytic tilt sensors. For example, electrolytic tilt sensors may be preferred over accelerometers due to the relatively small size of electrolytic tilt sensors (e.g., approximately 0.4" in diameter) as compared to the size of some accelerometer devices (e.g., approximately 1.25" in diameter). The relatively small size of electrolytic tilt sensing devices enables their use as a drop-in replacement for the conventional mechanical CVD survey tool. Signal transmission between survey tool 60 and tool/system interface 120 (in a WL or MAD survey system) or a communication subassembly (in a MWD survey system) occurs via I/O pins 270.

As shown in FIG. 2, system processor 200 is adapted to transmit a signal (Tx[1:N]) to and receive a signal (Rx[1:M]) from sensor processor 210. In general, transmit signal Tx[1:N] is an "enable signal" and may, in some cases, communicate to sensor processor 210 when a sensor measurement is to be taken with tilt-sensing devices 220. In other cases, however, the enable signal may only initiate transmission of Rx[1:M] from sensor processor 210 to system processor 200. In any case, signal Rx[1:M] may include raw sensor data from tilt-sensing devices 220 and/or processed sensor data from sensor processor 210. The means for processing the raw sensor data and results thereof (i.e., the processed sensor data) will be described in more detail below in reference to FIGS. 3A, 3B and 5.

The raw and/or processed sensor data may then be transferred to memory device 230 for storage therein. In a preferred embodiment, however, only processed sensor data is stored within memory device 230 to thereby minimize the required storage capacity of memory device 230. Memory device 230 may include, for example, a reprogrammable non-volatile storage device, such as a non-volatile random access memory (NVRAM) device, an erasable programmable read-only memory (EPROM) device, an electrically erasable programmable read-only memory (EEPROM) device, or a FLASH memory device. The type and storage capacity of memory device 230 may be appropriately selected to accommodate a specific application.

As shown in FIG. 2, survey tool 60 preferably includes clocking device 240. In a preferred embodiment, clocking device 240 is a real-time clock for tracking the current time not only in terms of hours, minutes and seconds, but also in terms of days, months and years. Such a real-time clock may be beneficial for precisely tracking an internal survey time. As described herein, a "survey time" refers to one or more time intervals during which tilt-sensing devices 220 are obtaining one or more sensor measurements. Alternatively, clocking device 240 may include any other appropriate means for tracking time.

Survey tool 60 may also include power supply 250, in some embodiments. For example, power supply 250 may be a voltage regulator, i.e., a circuit or device that provides a constant voltage to a load. Voltage regulators are commonly known in the art, and thus, will not be discussed in detail herein. It will be noted, however, that power supply 250 may be used, in some cases, to regulate a reference voltage (e.g., $V_{IN}$ at voltage input pin 260) received from a battery unit (not shown). Such a battery unit may be included within survey tool 60, or alternatively, within the BHA of a MWD or MAD survey system. It is also noteworthy to mention that the minimal power consumption of tilt-sensing devices 220 may be responsible, in part, for allowing battery operation of survey tool 60. In other cases, however, power supply 250 may regulate a reference voltage received from a power source external to survey tool 60. Such a power source may reside within surface instrumentation, or alternatively, be generated by rotational motion of certain BHA components.

In some embodiments, survey tool 60 may also include optional shock sensor 280. In general, shock sensor 280 may be any discrete device capable of detecting vibration associated with motion and/or a "shock event." As described herein, a shock event may indicate the landing of a survey tool in a WL application, or may indicate the presence of drilling activity in a MWD application. In some cases, a shock event may also indicate problematic drilling conditions such as "stick slipping" of the drilling bit or excessive vibrations of the BHA. In general, shock sensor 280 may be comprised of an electrical switching device, which closes each time sensor 280 experiences significant shock. In particular, shock sensor 280 may be comprised of, for example, an accelerometer switch or a shock counter device.

In MWD or MAD survey systems, survey tools are often required to run many times longer than when deployed in a WL survey system. In some embodiments, therefore, survey tool 60 may also include power management switch 255 coupled between shock sensor 280 and system processor 200. In general, power management switch 255 is configured to force the survey tool into a "sleep mode" during times in which shock is detected by shock sensor 280. In some cases, measurement data may not be obtained during such a sleep mode. In addition, power management switch 255 allows measurement data to be obtained during "wake modes," or times after which substantially no shock is detected for a predefined period of time (e.g., 30 seconds). In this manner, power management switch 255 allows the survey tool to be switched "off" during drilling activity to thereby conserve power consumption of the survey tool.

In some embodiments, survey tool 60 may also include optional sensor selection means 290 for selecting one tilt-sensing device from the plurality of tilt-sensing devices 220 included within the housing. In particular, sensor selection means 290 is configured to select an appropriate tilt-sensing device when each of the plurality of devices 220 exhibits a different operational range. In some cases, sensor selection means 290 may include another sensing device such as, e.g., an accelerometer device, for selecting the tilt-sensing device having the appropriate operational range. In other cases, sensor selection means 290 may include a selection device such as, e.g., a multiplexer, for sequentially selecting each one of the plurality of tilt-sensing devices 220. An exemplary method for using sensor selection means 290 to select the one tilt-sensing device is discussed in more detail below in reference to FIGS. 7 and 8.

As described above, tilt-sensing devices 220 preferably include one or more electrolytic tilt-sensing devices; the configuration and operation of which will now be described in reference to FIGS. 3A and 3B. Generally speaking, electrolytic tilt-sensing devices are adapted to provide an output voltage, which is proportional to a tilt angle and phase (i.e., tilt direction) associated with the tilt-sensing device. In particular, the output voltage is derived from a change in resistance between a plurality of electrodes immersed within an electrolyte, and is a function of the amount of tilt experienced by the electrolyte due to the force of gravity.

Figure 3A:
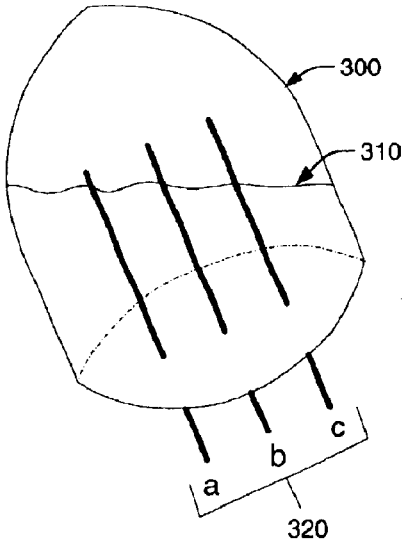
FIG. 3 is a vector diagram illustrating an exemplary wellbore inclination angle, $\theta_w$, which is determined from tilt angles, $\theta_{XZ}$ and $\theta_{YZ}$, measured by an electrolytic tilt-sensing device within the survey tool shown in FIG. 2.

More specifically, electrolytic tilt sensor is shown in FIG. 3A as comprising a housing 300, which is partially filled with an electrolytic solution 310 (also referred to as an electrolyte). Though housing 300 is usually formed of glass, it may alternatively be formed of any suitable non-conductive material. As shown in FIG. 3A, housing 300 encloses a plurality of electrodes 320, which are uniformly immersed in electrolytic solution 310 when the tilt sensor is in an upright (i.e., zero tilt or electrical null) position. One of the electrodes (e.g., a center electrode) is a common electrode, whereas the remaining electrodes are sensing electrodes. The sensing electrodes are grouped into one or more pairs for defining (in conjunction with the common electrode) one or more orthogonal axes of the tilt sensor.

As shown in FIG. 3A, for example, a single-axis electrolytic tilt sensor may include a common electrode (e.g., electrode b) and one pair of sensing electrodes (e.g., electrodes a and c). A dual-axis electrolytic tilt sensor (not shown), on the other hand, may include a common electrode and two pairs of sensing electrodes. In a dual-axis sensor configuration, each of the pairs of sensing electrodes is sensitive along a different orthogonal axis of the tilt sensor. A tri-axis electrolytic tilt sensor (not shown) having three or more pairs of sensing electrodes may also be configured, such that each pair (along with the common electrode) provides a measure of tilt along each of the three orthogonal axes of the tilt sensor. As will be described in more detail below, however, tilt measurements may only be needed along two of the three orthogonal axes of the tilt sensor for accurately determining the inclination of a wellbore.

Tilting the electrolytic tilt sensor away from the upright position causes each of the sensing electrodes to become more or less immersed in the electrolytic solution, while the surface of the electrolytic solution remains substantially level due to gravitational forces. Due to the electrical conductivity of the electrolytic solution, however, an increase or decrease in immersion may cause a corresponding change in resistance between any one of the sensing electrodes and the common electrode. This change in resistance is measured by an electrical circuit (e.g., Wheatstone bridge, not shown) and correlated to a tilt angle and/or tilt direction, depending on the number of sensing electrodes and type of electrical circuit being used.

Conventionally, electrolytic tilt-sensing devices have been used in a variety of applications, such as weapons delivery and aircraft navigation, to determine the amount of tilt experienced by a tilting apparatus (e.g., an aircraft) with respect to a coordinate system defined by the tilting apparatus. In other words, electrolytic tilt sensors have been used to measure rotation (i.e., the amount of tilt) about one or more axes of a tilting apparatus. However, electrolytic tilt sensors have not been used to directly determine the amount of tilt experienced by a structure (e.g.,a wellbore), which is unattached to the tilting apparatus (e.g., a survey tool). More specifically, the present inventors are unaware of prior means for determining the inclination of a wellbore using electrolytic tilt-sensing devices without also using other positioning sensors, such as accelerometers and gyroscopes.

A means for determining the orientation of a tilting apparatus using electrolytic tilt-sensing devices in combination with tri-axis accelerometers has been disclosed, for example, in U.S. Pat. No. 5,606,124 to Doyle et al. (hereinafter "Doyle"). More specifically, Doyle discloses an apparatus and method for determining the gravitational orientation of a well logging instrument (i.e., a survey tool), which utilizes both electrolytic tilt-sensing and accelerometer devices. Doyle, however, fails to suggest that the orientation of a wellbore could be determined using only measurements obtained from an electrolytic tilt-sensing device. In fact, Doyle uses an electrolytic tilt-sensing device merely for calibrating the error prone accelerometer measurements. As such, one of ordinary skill in the art would not necessarily conclude, in light of Doyle, that electrolytic tilt sensor measurements could be used alone (i.e., without combined use with measurements from accelerometer devices or other orientation sensors) to determine the inclination of a wellbore.

Therefore, a novel means is disclosed herein for determining the inclination of a wellbore without the need for other orientation sensors, such as accelerometer and gyroscope devices, conventionally used to determine the same. In particular, the present invention provides a survey tool, such as survey tool 60 of FIG. 1, having one or more electrolytic tilt-sensing devices fixedly coupled therein. As mentioned above, survey tool 60 may include a dual-axis electrolytic tilt-sensing device, or alternatively, may include two single-axis electrolytic tilt-sensing devices. The choice between single-axis and dual-axis devices is generally application specific and may be dependent on desired cost, accuracy, and operational range, in most cases. For example, two single-axis electrolytic tilt sensors may be positioned along orthogonal axes of the tilt sensor when increased accuracy (e.g., ±0.1 degrees) is desired over a reduced range (e.g., 0–5 degrees) of measurable tilt angles. However, a dual-axis electrolytic tilt sensor may be preferred when a reduction in cost (e.g., dual-axis sensors are approximately a factor of 10 cheaper than single-axis sensors) is desired in addition to an increased operational range (e.g., 0–180 degrees).

In any case, one or two electrolytic tilt sensors are sufficient to accurately determine the inclination of a wellbore, as opposed to other positioning sensors, which generally require three or more sensors to obtain a similar accuracy. Such an advantage may be due, in part, to the customization of electrolytic tilt sensors and the resultant reduction in sensor sensitivity to changes in the operational environment. In other words, electrolytic tilt sensors can be tailored for operation within a specific environment by selecting appropriate compositions and configurations for electrolytic solution 310 and/or electrodes 320.

For example, an electrolyte (i.e., an electrolytic solution) is generally comprised of a salt (capable of conducting an electrical charge) and one or more solvents. In some cases, the chemistry of electrolytic solution 310 may be selected to accommodate the higher temperatures and increased vibrations normally encountered during a well survey. To accommodate vibrations, for example, a higher salt concentration may be selected to increase the viscosity of the electrolyte and further dampen the time response of the tilt sensor. To accommodate higher temperatures, on the other hand, a solvent having a higher boiling point may be selected for the electrolyte chemistry. Alternatively, or in addition to, the volume of electrolytic solution 310 may be appropriately chosen to maximize the accuracy of the sensor. For example, increasing the volume of the electrolyte effectively increases the resolution (and therefore, the accuracy) of the sensor by increasing the amount of fluid that is displaced (i.e., the total volume of the change in the fluid) when the sensor is tilted.

The electrolytic salts and solvents available for use in electrolytic solution 310 are commonly known, and thus, are not fully described herein. In a preferred embodiment, however, electrolytic solution 310 may include electrolytic salts that are less susceptible to electrolytic breakdown and solvents, which are capable of withstanding temperatures between approximately −20° C. and +150° C. Tailoring the electrolytic solution for use in a particular application is well known in the art; thus, the exact composition of electrolytic solution 310 will not be discussed herein. Substantially any combination of commonly known salts and solvents may be included within electrolytic solution 310.

The material composition of electrodes 320 may also be chosen (with regard to the chosen electrolyte) to ensure a stability of the electrolytic tilt sensor over time and with changes in temperature. As noted above, such stability may advantageously eliminate the need for periodic recalibration and/or the need to correct sensor measurements for undesirable errors and biases. Generally speaking, an electrolytic tilt sensor (and accompanying circuitry) provides an output voltage, which is correlated to the tilt angle experienced by the sensor. Therefore, to ensure accurate and reliable operation over time and temperature, the electrical parameters of the tilt-sensing device must remain stable. In particular, a stable resitivity of electrolytic solution 310 may be required for the output voltage to remain accurately correlated to tilt angle.

As such, the material composition of electrodes 320 may be selected, in some cases, from a variety of precious metals known for their chemical stability. In this manner, precious metal electrodes may be chosen to suppress electrochemical reactions, which would otherwise cause an undesirable change in the electrolyte resitivity. Alternatively, the material composition of electrodes 320 may be selected from a variety of non-precious metals, in other cases. However, an appropriate electrolyte must be chosen to suppress the electrochemical reactions caused, in part, by the use of a non-precious metal electrode. Alternatively, electrodes 320 may include a non-precious metal having a precious metal coating or a non-metallic material having a precious metal coating.

Figure 3B:
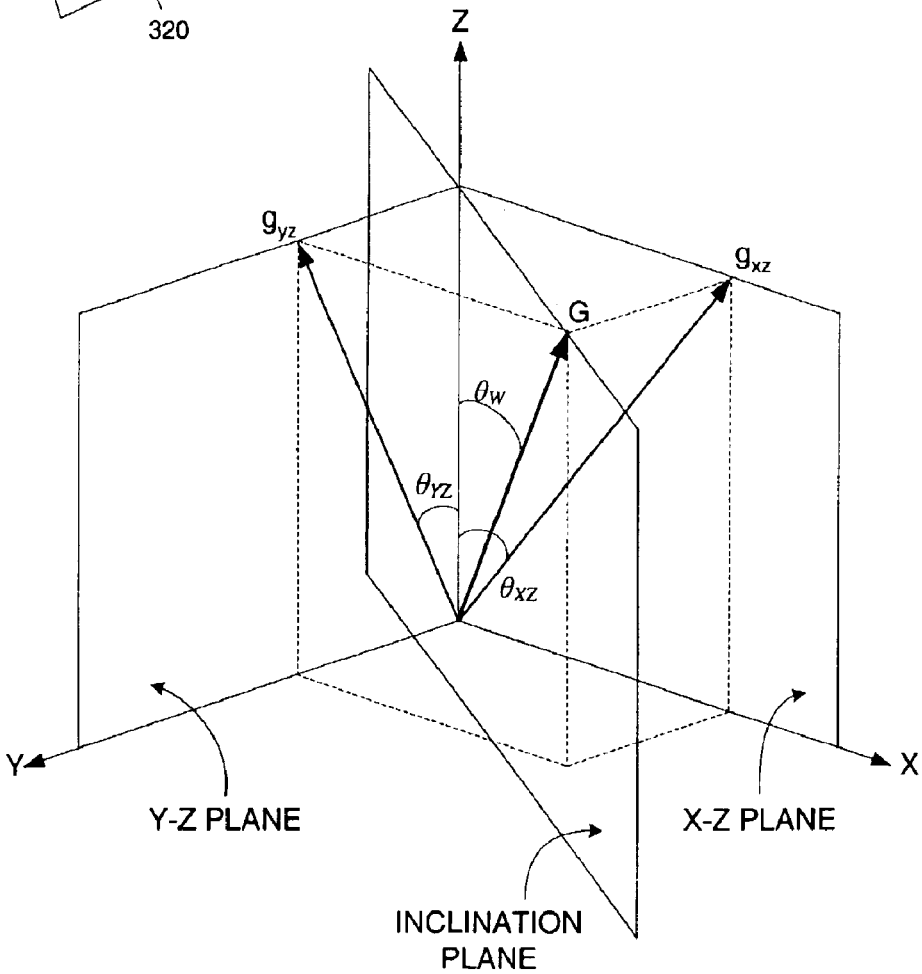

FIG. 3B is a vector diagram used herein to describe the relationship between electrolytic tilt sensor measurements and the calculated wellbore inclination angle. For example, FIG. 3B shows survey tool 60 as having an (x,y,z) coordinate system, where the x- and y-axes refer to transverse axes while the z-axis refers to longitudinal axis of the survey tool. Note, however, that FIG. 3B is shown in an upside down position for purposes of drawing simplicity. In reality the gravitational vector, G, denotes a true vertical direction, thus, the z-axis may be described herein as roughly directed in a downward course.

When using electrolytic tilt sensors, wellbore inclination may be accurately determined by measuring the amount of tilt associated with the transverse axes (i.e.,the x- and y-axes) of the survey tool. As such, a dual-axis tilt sensor may be fixedly attached within survey tool 60, in some cases, for measuring a tilt angle within each of the transverse planes of the survey tool. These transverse planes are shown in FIG. 3B as orthogonal X-Z and Y-Z planes. In other cases, however, a single-axis tilt sensor may be fixedly attached along each of the transverse axes of survey tool 60 for measuring tilt angles within the X-Z and Y-Z planes. As will be described in more detail below, the tilt angles, $\theta_{XZ}$ and $\theta_{YZ}$, measured within each of the transverse planes can be used to determine the inclination angle, $\theta_W$, which lies within an inclination plane of survey tool 60. As used herein, the term "inclination plane" refers to the two-dimensional space defined by the longitudinal axis of survey tool 60 and the gravitational vector.

As such, FIG. 3B illustrates the relationship between the tilt angles, $\theta_{XZ}$ and $\theta_{YZ}$, measured by electrolytic tilt-sensing devices 220 and the inclination angle, $\theta_W$. For example, FIG. 3B describes tilt angle $\theta_{XZ}$ as the angle between the projection of G onto the X-Z plane (denoted as $g_{xz}$) and the z-axis of the survey tool. Similarly, the tilt angle $\theta_{YZ}$ is described in FIG. 3B as the angle between the projection of G onto the Y-Z plane (denoted as $g_{yz}$) and the z-axis of the survey tool. Therefore, when the z-axis of survey tool 60 is in substantial alignment with the longitudinal axis of the wellbore, the inclination angle, $\theta_W$, can be described as:

$$\theta_W=\sqrt{\tan[\theta_{XZ}^2+\tan(\theta_{YZ}^2)]} \qquad \text{Equ. (1)}$$

In some embodiments, the alignment between the z-axis of survey tool 60 and the longitudinal axis of the wellbore is due to the landing of survey tool 60 onto landing ring 27. As noted above, landing ring 27 functions to position survey tool 60 in alignment with the direction of drill bit 25, and thus, in substantial alignment with the longitudinal axis of the wellbore. In such embodiments, the inclination angle, $\theta_W$, also indicates the inclination of the wellbore.

Figure 5:
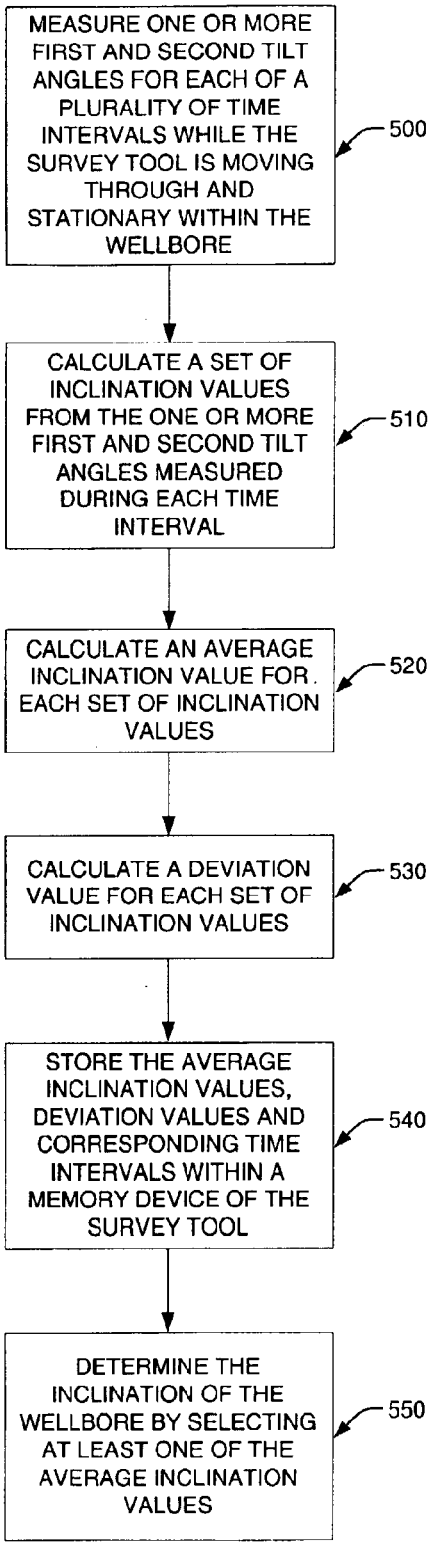
FIG. 5 is a flow chart diagram of an exemplary method for determining the wellbore inclination angle shown in FIG. 3.

Exemplary methods for conducting a well survey using survey tool 60 will now be described in reference to FIGS. 5–9. FIG. 5, for example, illustrates an exemplary method for determining the inclination of a wellbore using survey tool 60. Though not shown in FIG. 5, the method generally begins by lowering or dropping survey tool 60 into a wellbore to conduct a WL survey. Alternatively, drilling activity may be periodically stopped to conduct a MWD or MAD survey. In step 500, the method may continue, in some embodiments, by measuring a first tilt angle (e.g., tilt angle $\theta_{XZ}$) within a first plane (e.g., the X-Z plane) and a second tilt angle (e.g., tilt angle $\theta_{YZ}$) within a second plane (e.g., the Y-Z plane) of electrolytic tilt-sensing devices 220. In step 510, an inclination value may be calculated by plugging the first and second tilt angles into Equ. (1), as described above. If only one survey measurement (i.e., one pair of measured first and second tilt angles) is obtained during the well survey, the calculated inclination value is selected as the inclination of the wellbore (e.g., inclination angle $\theta_W$) in step 550.

In other embodiments, however, it may be desirable to obtain more than one survey measurement during a well survey. As such, step 500 preferably includes measuring a plurality of first and second tilt angles for each of plurality of time intervals. In one example, 10–20 survey measurements may be taken for each of the plurality of time intervals. However, the number of survey measurements per time interval is not limited to such an example, and may alternatively include any reasonable number. The plurality of time intervals may include, in some cases, distinct time intervals (e.g., 1-second time intervals) individually separated by a period of time (e.g., a 10-second time period) in which no measurements are taken by electrolytic tilt-sensing devices 220. In other cases, the plurality of time intervals may include a plurality of continuous time intervals (e.g., 1-second time intervals) over which a continuous stream of survey measurements is taken by electrolytic tilt-sensing devices 220. Note, however, that substantially any length of time may be used to describe the distinct time intervals and intermediate time periods, or alternatively, the continuous time intervals.

In some cases, the plurality of first and second tilt angles may be measured while survey tool 60 is held stationary within the wellbore. For example, a plurality of survey measurements may be taken after survey tool 60 has landed (e.g., on landing ring 27) at the bottom of the wellbore. Alternatively, the plurality of survey measurements may be taken at times when survey tool 60 is temporarily stopped at one or more depth locations within the wellbore. In other cases, however, it may be desirable to obtain survey measurements while survey tool 60 is moving through the wellbore, in addition to the measurements obtained while survey tool 60 is held stationary within the wellbore. As will be described in more detail below, such a case may increase the accuracy of the calculated wellbore inclination angle through the disqualification of measurements taken while the tool is in motion.

In step 510, a set of inclination values may be calculated from the plurality of first and second tilt angles measured during each of the plurality of time intervals. Each inclination value may be calculated, for example, by plugging a corresponding pair of first and second tilt angles into Equ. (1). In this manner, a "set of inclination values" refers to the inclination values calculated from each pair of first and second tilt angles measured during a particular time interval. Subsequently, the method continues by calculating an average inclination value (in step 520) and a deviation value (in step 530) for each set of inclination values. Each deviation value may be calculated, for example, as a standard deviation of a particular set of inclination values. However, any other appropriate statistical calculation known in the art can alternatively be used to calculate the deviation value. As will be described in more detail below, deviation values may be used to indicate motion or vibration associated with the survey tool.

As noted above in the discussion of FIG. 2, "raw sensor data" is used herein to describe the tilt angles, which are measured by electrolytic tilt sensors 220 and sent to sensor processor 210. In some cases, sensor processor 210 may be adapted to determine and transmit the inclination values as "processed sensor data" to system processor 200. In such a case, system processor 200 may be adapted to determine the average inclination and deviation values from the processed sensor data. In other cases, however, sensor processor 210 may be further adapted to determine and transmit the average inclination and deviation values as "processed sensor data" to system processor 200. In such a case, the inclination values may or may not be transmitted to system processor 200, depending on, e.g., the storage capacity of memory device 230.

In step 540, the raw sensor data and/or processed sensor data may be stored within memory device 230. As noted above, however, only the processed sensor data may be stored within memory device 230 if a reduced storage capacity is desired. In a preferred embodiment, the raw and/or processed sensor data is correlated to a corresponding time interval before storage within the memory device. In this manner, memory device 230 may include a time-based well log comprising some or all of the raw data measurements, the set of inclination values, the average inclination value, and the deviation value associated with each of the stored plurality of time intervals.

In step 550, the inclination of the wellbore may be determined by selecting at least one of the average inclination values stored within the time-based well log. In some cases, step 550 may occur while survey tool 60 is disposed within the wellbore. As such, system processor 200 may be adapted, in one example, to determine the inclination of the wellbore. In particular, system processor 200 may utilize an algorithm stored within memory device 230 to determine the inclination of the wellbore by selecting an appropriate average inclination value. Means for selecting the "appropriate" average inclination value will be described in more detail below. After retrieving survey tool 60 from the wellbore, the selected wellbore inclination angle may be displayed on an external panel of the survey tool and/or downloaded for display upon display device 470 of surface computer terminal 110.

In another example, however, the data within memory device 230 may be transmitted up-hole to surface computer terminal 110 via any of the signal transmission means described above in reference to FIGS. 1 and 2 (e.g., by electrical, "mud pulse," or EM transmission). As such, processor 410 may utilize an algorithm stored within memory device 400 to automatically select the appropriate wellbore inclination angle. Alternatively, the transmitted data may be displayed upon display device 470 for allowing a system operator to manually select the appropriate wellbore inclination angle. Subsequently, the selected wellbore inclination angle may be displayed to the operator (via, e.g., display device 470 or peripheral devices 480) and/or stored within memory device 400.

In other cases, however, step 550 may occur at the surface after survey tool 60 is retrieved from the wellbore. For example, the data stored within memory device 230 may be downloaded to surface computer terminal 110 via tool/system interface 120, as described above. Next, the appropriate wellbore inclination angle may be automatically selected by processor 410 or manually selected by an operator. For example, the appropriate wellbore inclination angle may be automatically or manually selected from a subset of inclination angles corresponding to relevant wellbore depths and/or requested survey time periods, which will be described in more detail below. Subsequently, the selected wellbore inclination angle may be displayed to the operator and/or stored within memory device 400.

Whether performed automatically or manually, uphole or downhole, the means for selecting an "appropriate" wellbore inclination angle may include selecting an average inclination value having a corresponding deviation value less than a predefined threshold, in some cases. As noted above, deviation values may be used herein as an indication of motion or vibration associated with the survey tool. In particular, a relatively high deviation value (e.g., substantially greater than 5% of the average deviation value) may indicate the presence of significant motion or vibration, whereas a relatively low deviation value (e.g., approximately 0–5%) may indicate little to no motion or vibration. Since a decrease in motion and vibration increases the accuracy of a survey measurement, it may be beneficial to select an average inclination value having a corresponding deviation value substantially less than 5%. Note, however, that alternative threshold values may be equally viable depending on the specific application in which they are applied.

In an alternative embodiment, the method may include determining a vibration value for each set of inclination values. Vibration values may be detected, for example, by a separate shock sensor (e.g., shock sensor 280 of FIG. 2) coupled within survey tool 60. In some cases, the vibration values may also be included in the time-based well log stored within memory device 230. As such, the means for selecting an "appropriate" wellbore inclination angle may alternatively include selecting an average inclination value having a corresponding vibration value less than a predefined threshold of (e.g., approximately 10 mgs rms). In yet another example, the "appropriate" wellbore inclination angle may be selected when at least one of a corresponding vibration value and a corresponding deviation value is less than their respective predefined thresholds.

As noted above, inaccurate readings may result when wellbore inclination angles are recorded at the wrong time and/or place within a wellbore. In a WL survey system, for example, problems with the survey cable may cause a survey tool to become stuck, at least temporarily, before the survey tool is allowed to continue through the wellbore. As such, inaccurate readings may be taken with prior art survey tools, which are set at the surface to obtain a reading after a predetermined and estimated amount of time. Other prior survey art tools have tried to overcome these problems by obtaining a reading a predetermined time delay after a "shock event" is detected. Unfortunately, such tools cannot account for instances in which the survey tool is significantly jarred (e.g., due to cable problems) at a location above the bottom surface and becomes stuck for an amount of time longer than the predetermined time delay. Therefore, an improved method is needed to determine an appropriate place for recording a survey measurement in a wire line or MAD survey.

Figure 6:
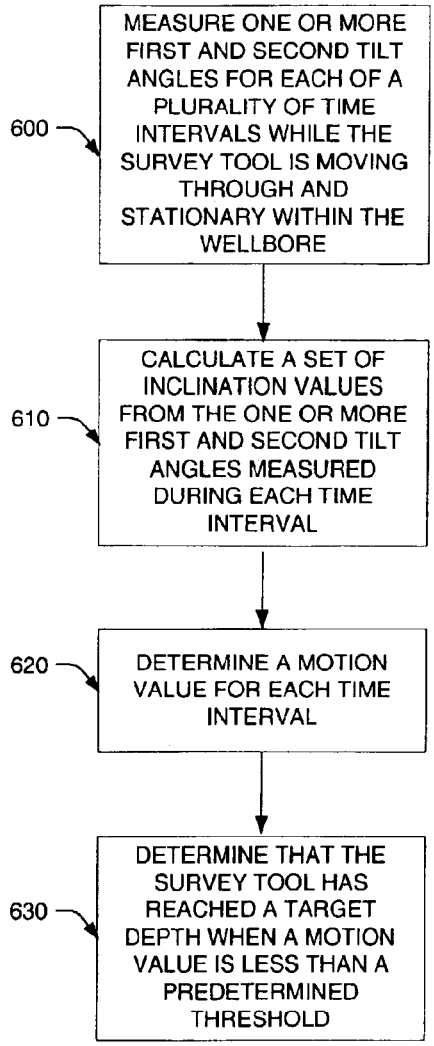
FIG. 6 is a flow chart diagram of an exemplary method for determining when a survey tool has reached a target depth within the wellbore.

Turning to FIG. 6, an exemplary method is described herein for determining where to record a survey measurement. In particular, FIG. 6 illustrates an exemplary method for determining when a survey tool has reached a target depth within a wellbore. As used herein, a "target depth" may refer to the lowest point obtainable by a survey tool disposed within the wellbore. For example, a survey tool may reach the "lowest point obtainable" upon reaching landing ring 27 at the bottom of the drill string. Alternatively, the "target depth" may refer to any location of depth at which the inclination of the wellbore is desired.

In some cases, the method may begin in step 600 by measuring one or more first and second tilt angles for each of a plurality of time intervals while the survey tool is moving towards the target depth. In other words, a plurality of survey measurements may be obtained while a survey tool is dropped or lowered into the wellbore. In step 610, a set of inclination values may be calculated from the one or more first and second tilt angles measured during each of the plurality of time intervals. In some cases, the inclination values may be calculated downhole within the survey tool (e.g., by sensor processor 210 or system processor 200). Alternatively, the inclination values may be calculated at the surface within surface computer terminal 110 (e.g., by processor 410). In such a case, however, the raw sensor data must be transmitted in real-time to surface computer terminal 110 to avoid an inaccurate determination of target depth.

In step 620, a motion value may be determined for each of the plurality of time intervals. In one embodiment, the motion value may include a deviation value calculated for each set of inclination values. As noted above, a deviation value may be calculated by finding the standard deviation of a set of inclination values, and may be used to indicate motion or vibration associated with the survey tool. As noted above, a relatively low deviation value (e.g., approximately 0–5% of the average deviation value) may indicate little to no motion or vibration. In an alternative embodiment, the motion value may include a vibration value detected (e.g., by shock sensor 280 of survey tool 60) during each of the plurality of time intervals. As such, a relatively low vibration value (e.g., approximately 0–10 mgs rms) may indicate little to no motion or vibration.

In step 630, it may be determined that the survey tool has reached the target depth when a deviation value is less than a predetermined threshold (e.g., approximately 5% of the average deviation value). Alternatively, it may be determined that the survey tool has reached the target depth when a vibration value is less than a predetermined threshold (e.g., approximately 10 mgs rms). In some cases, such determination may be performed automatically by downhole and/or surface instrumentation, or alternatively, may be performed manually by an operator, in other cases. In this manner, the current method provides a means for detecting and distinguishing a landing event from other shock events that may occur while the tool is moving towards, but has not yet reached, the target depth. For example, a shock event followed by vibration or movement would indicate that a landing event has not yet occurred.

In addition to determining an appropriate place for recording a survey measurement, it may further be desirable to provide a means for an operator to specify an appropriate time for recording the survey measurement. As such, a simple means is provided for allowing an operator to request a survey time period at the surface without direct communication with a downhole survey tool. Such means are described herein with reference to FIGS. 1 and 2.

In particular, sensor means may be included for measuring a plurality of first and second tilt angles for each one of a plurality of time intervals. More specifically, one or more electrolytic tilt-sensing devices 220 may be used to measure the first and second tilt angles while survey tool 60 is moving through and while survey tool 60 is held stationary within the wellbore. In a preferred embodiment, survey tool 60 includes a processing means for calculating a set of inclination values from the plurality of first and second tilt angles measured during each of the plurality of time intervals. As noted above, such processing means may include system processor 200 or sensor processor 210. Survey tool 60 may also include a clocking means for tracking the plurality of time intervals. Preferably, such clocking means includes clocking device 240, which may be a real-time clock, as described above in FIG. 2. In this manner, each of the plurality of time intervals may be correlated to a corresponding set of inclination values before storage of such within a time-based well log.

Another clocking means may be included within surface computer terminal 110 for flagging a requested survey time period. As used herein, a "requested survey time period" refers to one or more time intervals during which an operator at the surface requests survey measurements to be taken. Such clocking means may include clocking device 430, which preferably comprises a real-time clock similar to clocking device 240. In addition, surface computer terminal 110 may include a processing means, such as processor 410, for comparing the requested survey time period with the plurality of time intervals tracked by clocking device 240. Such processing means may further be used for identifying the one or more sets of inclination values that fall within the requested survey time period.

In some cases, an operator may request a survey time period at the surface by entering, for example, one or more survey time periods into I/O device 460 of surface computer terminal 110. In this manner, the operator may request that one or more survey measurements be taken during one or more specified periods of time. In another example, an operator may request a survey time period by entering one or more wellbore depths into I/O device 460. The entered wellbore depths may then be correlated to time (e.g., through a time/depth correlation) and/or detected by circuitry within the survey tool to determine when the one or more survey measurements are requested. For example, circuitry within the survey tool may be configured to detect non-uniformities in the drill pipe (e.g., joints between drill pipe sections) to determine the approximate depth of the survey tool as it traverses the wellbore. Alternatively, a particular button or actuator upon I/O device 460 may be pressed by the operator to flag a current time as the requested survey time period.

No matter what means are used at the surface to flag the requested survey time periods, it may be preferred to retrieve the survey tool from the wellbore before downloading the time-based well log to the surface computer terminal. For example, communication between a downhole survey tool and a surface computer terminal via any of the means described above (i.e., mud pulse, EM, or wireline transmission) is relatively more expensive (usually by several orders of magnitude) and complex than the means described herein. Therefore, the means described herein provide a cost effective and simple solution for requesting a survey time period in real time.

Figure 7:
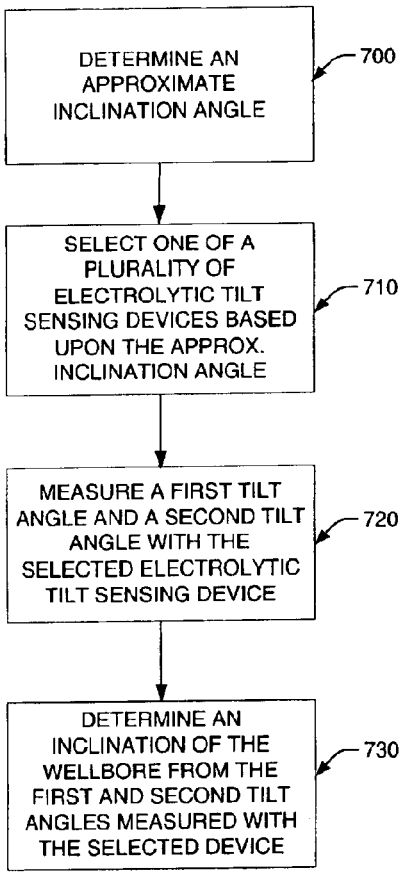
FIG. 7 is a flow chart diagram of an exemplary method for selecting one of a plurality of tilt-sensing devices to be used in the determination of the wellbore inclination angle.
Figure 8:
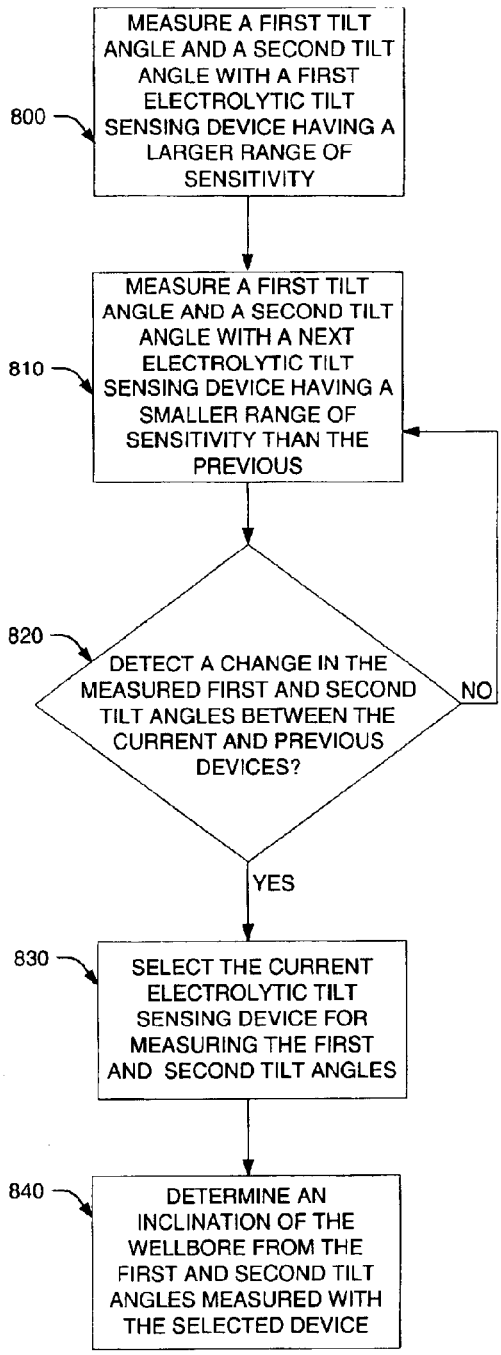
FIG. 8 is a flow chart diagram of another exemplary method for selecting one of a plurality of tilt-sensing devices to be used in the determination of the wellbore inclination angle.
Figure 9:
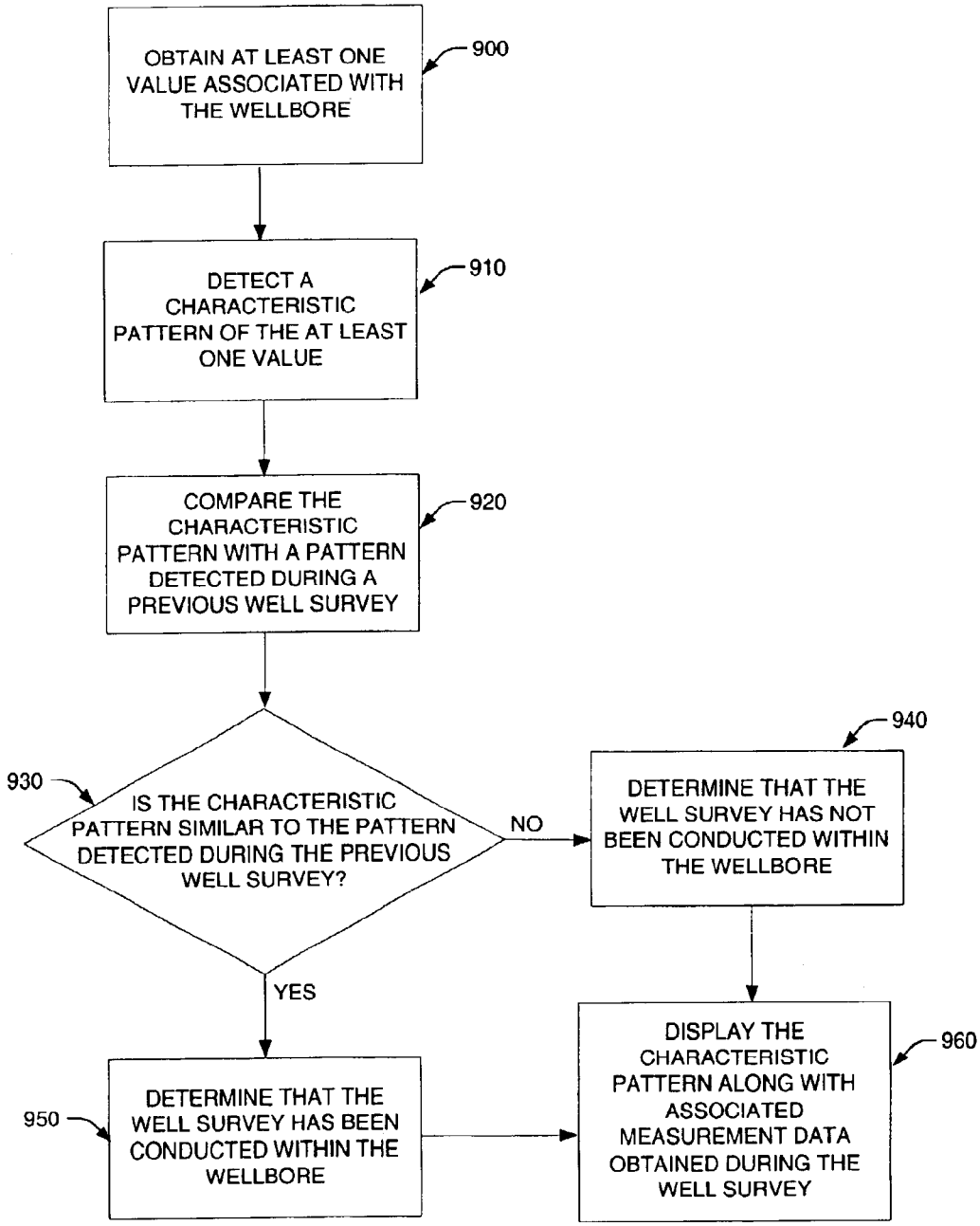
FIG. 9 is a flow chart diagram of exemplary methods for determining whether a well survey is actually conducted within a wellbore.

As noted above, tilt-sensing devices 220 may include, in some cases, a plurality of electrolytic tilt-sensing devices each of which are sensitive over a different range of inclination angles. As such, FIGS. 7 and 8 illustrate exemplary methods for selecting an appropriate tilt-sensing device. In particular, FIG. 7 illustrates an exemplary method for determining wellbore inclination using a survey tool comprising a plurality of electrolytic tilt-sensing devices sensitive over consecutive ranges of inclination angles. For example, five tilt sensors may be included within survey tool 60, where each sensor is sensitive over a different one of the following ranges: ±0–10°, ±10–20°, ±20–30°, ±30–40°, ±40–50°. Note, however, survey tool 60 may alternatively include any number of sensors comprising any overlapping or non-overlapping ranges of operation.

In step 700, an approximate inclination angle may be determined by sensor selection means 290 within survey tool 60. As described above in FIG. 2, sensor selection means 290 may include an alternative sensing device such as, e.g., an accelerometer device. In step 710, one of the plurality of tilt-sensing devices may be selected based on the approximate inclination angle detected by sensor selection means 290. Returning to the above example, an approximate inclination angle of 15° would cause sensor processor 210 to select the tilt sensor having an operational range of ±10–20°. In step 720, first and second tilt angles are measured with the selected tilt-sensing device, and used for determining the inclination of the wellbore in step 730. In this manner, an inaccurate reading may be avoided by ensuring the survey measurements are obtained from a tilt-sensing device having an appropriate operational range.

FIG. 8, on the other hand, illustrates an exemplary method for determining wellbore inclination using a survey tool comprising a plurality of electrolytic tilt-sensing devices sensitive over increasing ranges of inclination angles. For example, five tilt sensors may be included within survey tool 60, where each sensor is sensitive over a different one of the following ranges: ±0–10°, ±0–20°, ±0–30°, ±0–40°, ±0–50°. As noted above, however, survey tool 60 may alternatively include any number of sensors comprising any overlapping or non-overlapping ranges of operation.

In step 800, first and second tilt angles may be measured with a tilt sensor having a substantially large range of sensitivity. In some cases, the tilt sensor having the largest range of sensitivity (e.g., ±0–50°) may be chosen to measure the first and second tilt angles. In other cases, however, another tilt sensor having a range of sensitivity substantially greater than an estimated wellbore inclination angle (e.g., ±0–30°) may be chosen. In any case, the first and second tilt angles may be re-measured in step 810 with a tilt sensor having a smaller range of sensitivity than the previous tilt sensor range. In some cases, any tilt sensor having a range smaller than the previous may be chosen. It may be preferred, however, to select tilt sensors in a sequential manner from largest to smallest range of sensitivity. In any case, the tilt sensors may be selected in some manner by sensor selection means 290, which as described above in reference to FIG. 2 may be a multiplexer device.

The first and second tilt angles obtained with the current and previous tilt sensors are then compared in step 820. In general, "out-of-range" tilt sensors may exhibit identical, although erroneous, measured values (i.e., first and second tilt angles), while a tilt sensor having an appropriate range may produce a different measured value. If a change between the current and previous measured values is not detected in step 820, the method may return to step 810 where a tilt-sensing device having an even smaller range of sensitivity is used to measure another set of first and second tilt angles. If a change between the current and previous measured values is detected in step 820, however, the current tilt sensor is selected in step 830 for taking survey measurements during the well survey. In step 840, the inclination of the wellbore may be determined using survey measurements obtained by the selected tilt sensor. In this manner, selecting a tilt-sensing device having an appropriate operational range may increase the accuracy of the survey measurements. For example, less accurate tilt-sensing devices having larger ranges of sensitivity may be passed by for tilt-sensing devices having increased accuracy but smaller ranges of sensitivity.

In some cases, it may be desirable to provide irrefutable proof that a well survey is, in fact, conducted within a wellbore. For example, many prior art survey tools can be manipulated to determine a fraudulent wellbore inclination angle while the survey tool is outside of the wellbore. The fraudulent wellbore inclination angle may then be presented as a true measurement to avoid penalties assessed by regulatory bodies. For these reasons, a method for determining if a well survey is actually conducted within a wellbore will be discussed in reference to FIG. 9.

In step 900, the method may begin by obtaining at least one value associated with the wellbore using a survey tool, such as survey tool 60. In some cases, step 900 may obtain at least one motion value during each of a plurality time intervals. Such a motion value may include, for example, a deviation value calculated from a set of inclination values, which are measured by a tilt-sensing device (e.g., electrolytic tilt sensors 220) within survey tool 60 during one of the plurality of time intervals. Such a motion value may alternatively include a vibration value, which is detected by a stock sensor (e.g., shock sensor 280) within survey tool 60 during one of the plurality of time intervals. In other cases, however, step 900 may obtain at least one temperature value during each of the plurality of time intervals. A temperature value may be an ambient temperature detected, e.g., by temperature sensor 285 within survey tool 60, during each of the plurality of time intervals.

In step 910, a characteristic pattern of the at least one value may be detected. In some cases, a characteristic pattern may be detected from the one or more motion values obtained in step 900. As noted above, a relatively high motion value indicates the presence of significant motion or vibration, whereas a relatively low motion value indicates little to no motion or vibration. Therefore, a characteristic pattern comprising motion values greater than a predetermined threshold (as described above) would provide evidence of vibration and/or movement associated with a survey tool during the course of a well survey. In other cases, however, a characteristic pattern may be detected from the one or more temperature values obtained in step 900. Such a characteristic pattern may be detected, for example, as a change (or a rate of change) in the temperature values obtained during the plurality of time intervals. Since the ambient temperature within a wellbore tends to increase with depth, a characteristic pattern of increasing temperature values followed by decreasing temperature values would provide evidence of a survey tool moving into and then out of a wellbore.

In general, a survey tool should experience a substantially consistent pattern of motion and/or temperature values when disposed within a particular wellbore. In other words, the measured motion and/or temperature values may be thought of as a "signature" of the particular wellbore. Therefore, the characteristic pattern may be compared (in step 920) with a pattern detected during a previous well survey to determine if the current well survey is conducted within the wellbore. If the characteristic pattern is similar to the pattern detected during the previous well survey in step 930, it is determined that the well survey was conducted within the wellbore in step 950. Otherwise, it is determined that the well survey was not conducted within the wellbore in step 940. In any case, the characteristic pattern and associated measurement data (e.g., raw and/or processed measurement data) may be displayed to an operator in step 960. Alternatively, the characteristic pattern and associated measurement data may be stored within memory device 230 or memory device 400.

It will be appreciated to those skilled in the art having the benefit of this disclosure that this invention is believed to provide a well survey system including a survey tool having one or more electrolytic tilt sensors arranged therein. The survey tool disclosed herein provides an accurate determination of wellbore inclination in either a WL or MWD application. Such a survey tool is also smaller, less expensive and more reliable than other electronic survey tools. Further modifications and alternative embodiments of various aspects of the invention will be apparent to those skilled in the art in view of this description. It is intended that the following claims be interpreted to embrace all such modifications and changes and, accordingly, the specification and drawings are to be regarded in an illustrative rather than a restrictive sense.

What is claimed is:

1. A well survey system comprising a survey tool for determining an inclination of a wellbore, wherein the survey tool comprises:

an electrolytic tilt sensor adapted to measure a first tilt angle within a first plane and a second tilt angle within a second plane of the electrolytic tilt sensor, wherein the second plane is orthogonal to the first plane; and a system processor adapted to determine the inclination of the wellbore based on the first and second tilt angles.

2. The well survey system as recited in claim 1, wherein the electrolytic tilt sensor is further adapted to measure a plurality of first and second tilt angles for each of a plurality of time intervals while the survey tool is moving through and while the survey tool is stationary within the wellbore.

3. The well survey system as recited in claim 2, wherein the survey tool further comprising a clocking device for tracking a survey time corresponding to each of the plurality of time intervals.

4. The well survey system as recited in claim 3, wherein the survey tool further comprises a sensor processor adapted to calculate a set of inclination values from the plurality of first and second tilt angles measured during each of the plurality of time intervals.

5. The well survey system as recited in claim 4, wherein the system processor is further adapted to determine an average inclination value for each set of inclination values.

6. The well survey system as recited in claim 5, wherein the system processor is further adapted to determine a deviation value for each set of inclination values.

7. The well survey system as recited in claim 6, wherein the survey tool further comprises a memory device for storing the average inclination value, deviation value, and survey time corresponding to each set of inclination values.

8. The well survey system as recited in claim 7, further comprising a surface computer terminal adapted to receive data including the average inclination value, deviation value, and survey time corresponding to each set of inclination values, and wherein the surface computer terminal comprises a display device for displaying the received data to an operator.

9. The well survey system as recited in claim 8, wherein the surface computer terminal further comprises a memory device for storing the received data within a records database.

10. The well survey system as recited in claim 9, wherein the surface computer terminal further comprises a processor adapted to sort and remove non-associated records from the records database to create an improved records database, and wherein the non-associated records exhibit deviation values greater than a predefined threshold.

11. The well survey system as recited in claim 3, further comprising a surface computer terminal adapted to receive the plurality of first and second tilt angles measured during each of the plurality of time intervals, and wherein the surface computer terminal comprises a processor adapted to:

calculate a set of inclination values from the plurality of first and second tilt angles measured during each of the plurality of time intervals;

determine an average inclination value for each set of inclination values;

determine a deviation value for each set of inclination values; and create a records database comprising the average inclination value, deviation value, and time interval corresponding to each set of inclination values.

12. The well survey system as recited in claim 1, wherein the system processor is adapted to determine the inclination of the wellbore without knowing an orientation of the electrolytic tilt sensor with respect to the wellbore.

13. A method for determining inclination of a wellbore with a survey tool comprising a tilt-sensing device, wherein the method comprises:

measuring a first tilt angle within a first plane and a second tilt angle within a second plane of the tilt-sensing device, wherein the second plane is orthogonal to the first plane; and calculating the inclination of the wellbore from the first and second tilt angles.

14. The method as recited in claim 13, wherein said step of measuring comprises measuring a plurality of first and second tilt angles for each of a plurality of time intervals while the survey tool is moving through and while the survey tool is stationary within the wellbore.

15. The method as recited in claim 14, further comprising calculating a set of inclination values from the plurality of first and second tilt angles measured during each of the plurality of time intervals.

16. The method as recited in claim 15, further comprising calculating an average inclination value for each set of inclination values.

17. The method as recited in claim 16, further comprising calculating a deviation value for each set of inclination values.

18. The method as recited in claim 17, further comprising storing within a memory device of the survey tool the average inclination values, deviation values and corresponding time intervals.

19. The method as recited in claim 17, further comprising determining the inclination of the wellbore by selecting at least one of the average inclination values.

20. The method as recited in claim 19, wherein said step of selecting comprises selecting an average inclination value as the inclination of the wellbore when a corresponding deviation value is less than a predefined threshold.

21. The method as recited in claim 19, further comprising determining a vibration value for each set of inclination values, wherein said vibration value is obtained from a shock sensor coupled within the survey tool.

22. The method as recited in claim 21, wherein said step of storing further comprises storing the vibration values.

23. The method as recited in claim 21, wherein said step of selecting comprises selecting an average inclination value as the inclination of the wellbore when at least one of a corresponding vibration value and a corresponding deviation value is less than a predefined threshold.

24. The method as recited in claim 13, wherein said step of calculating is performed without knowing an orientation of the tilt-sensing device with respect to the wellbore.

25. A method for determining when a survey tool has reached a target depth within a wellbore, wherein said survey tool comprises a dual-axis tilt-sensing device, and wherein said method comprises:

measuring a first tilt angle within a first plane and a second tilt angle within a second plane of the dual-axis tilt-sensing device, wherein said measuring comprises measuring a plurality of the first and second tilt angles for each one of a plurality of time intervals while the survey tool is moving towards the target depth;

calculating a set of inclination values from the plurality of first and second tilt angles measured during each of the plurality of time intervals;

calculating a deviation value for each set of inclination values; and determining that the survey tool has reached the target depth when a deviation value is less than a predetermined threshold.

26. A means for an operator to specify a survey time period at a surface computer terminal while a survey tool is within a wellbore, said means comprising:

a sensor means within the survey tool for measuring a plurality of first and second tilt angles for each one of a plurality of time intervals, wherein the sensor means are adapted to measure the first and second tilt angles while the survey tool is moving through and while the survey tool is stationary within the wellbore;

a processing means within the survey tool for calculating a set of inclination values from the plurality of first and second tilt angles measured during each of the plurality of time intervals;

a clocking means within the survey tool for correlating each of the plurality of time intervals to a corresponding set of inclination values;

a clocking means within the surface computer terminal for flagging a survey time period within which the operator requests a survey to be taken; and a processing means within the surface computer terminal for comparing the survey time period with the plurality of time intervals to identify the one or more sets of inclination values, which fall within the survey time period.

27. The means as recited in claim 26, further comprising a means for an operator to request a survey time period without communication with the survey tool.

28. The means as recited in claim 27, wherein said means comprises entering one or more survey time periods into an I/O device of the surface computer terminal.

29. The means as recited in claim 27, wherein said means comprises entering one or more wellbore depths into an I/O device of the surface computer terminal.

30. The means as recited in claim 27, wherein said means comprises pressing a button upon an I/O device of the surface computer terminal to flag a current time indicated by the clocking means within the surface computer terminal.

31. A method for determining inclination of a wellbore with a survey tool comprising a plurality of electrolytic tilt-sensing devices each sensitive over a different range of inclination angles, wherein the method comprises:

selecting one of the plurality of electrolytic tilt-sensing devices to measure a first tilt angle within a first plane and a second tilt angle within a second plane of the selected electrolytic tilt-sensing device; and determining the inclination of the wellbore from the measured first and second tilt angles.

32. The method as recited in claim 31, wherein said step of selecting comprises determining an approximate inclination angle using another sensing device to thereby select the one of the plurality of electrolytic tilt-sensing devices.

33. The method as recited in claim 31, wherein said step of selecting comprises measuring the first and second tilt angles with each of the plurality of electrolytic tilt-sensing devices in a sequential manner, wherein said sequential manner comprises measuring the first and second tilt angles with an electrolytic tilt-sensing device having a larger range of sensitivity prior to measuring the first and second tilt angles with another electrolytic tilt-sensing device having a smaller range of sensitivity, and selecting the one of the plurality of electrolytic tilt-sensing devices when at least one of the measured first and second tilt angles changes from a constant value to a different value.

34. A method for determining if a well survey is conducted within a wellbore, the method comprising:

obtaining at least one value associated with the wellbore using a survey tool;

detecting a characteristic pattern of the at least one value; and comparing the characteristic pattern with a pattern detected during a previous well survey to determine if the well survey is conducted within the wellbore.

35. The method as recited in claim 34, wherein the well survey is determined to be conducted within the wellbore if the characteristic pattern is similar to the pattern detected during the previous well survey.

36. The method as recited in claim 34, further comprising displaying the characteristic pattern along with associated measurement data obtained during the well survey.

37. The method as recited in claim 34, wherein said step of obtaining comprises obtaining at least one motion value during each of a plurality of time intervals.

38. The method as recited in claim 37, wherein said at least one motion value comprises a deviation value calculated from a set of inclination values, which are measured by a tilt-sensing device of the survey tool during one of plurality of time intervals.

39. The method as recited in claim 37, wherein said at least one motion value comprises a vibration value, which is detected by a shock sensor of the survey tool during one of the plurality of time intervals.

40. The method as recited in claim 37, wherein said step of detecting a characteristic pattern comprises detecting when the motion values are greater than a predetermined threshold.

41. The method as recited in claim 40, wherein said step of obtaining further comprises obtaining at least one temperature value during each of the plurality of time intervals.

42. The method as recited in claim 41, wherein said step of detecting a characteristic pattern further comprises detecting a change in the temperature values obtained during the plurality of time intervals.

43. The method as recited in claim 41, wherein said step of detecting a characteristic pattern further comprises detecting a rate of change in the temperature values obtained during the plurality of time intervals.

* * * * *